US007396100B2

(12) United States Patent
Hara

(10) Patent No.: US 7,396,100 B2
(45) Date of Patent: Jul. 8, 2008

(54) INK JET PRINTING APPARATUS AND INK JET PRINTING METHOD

(75) Inventor: Katsushi Hara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 333 days.

(21) Appl. No.: 10/985,966

(22) Filed: Nov. 12, 2004

(65) Prior Publication Data

US 2005/0104915 A1 May 19, 2005

(30) Foreign Application Priority Data

Nov. 14, 2003 (JP) ..... 2003-385747

(51) Int. Cl.
*B41J 29/393* (2006.01)

(52) U.S. Cl. ..... 347/19; 347/14; 347/41

(58) Field of Classification Search ..... 347/14, 347/19, 41, 16, 101, 104, 105
See application file for complete search history.

(56) References Cited

U.S. PATENT DOCUMENTS 6,050,674 A * 4/2000 Hirabayashi et al. ..... 347/40
6,669,331 B2 12/2003 Teshigawara et al. ..... 347/43
2002/0171709 A1 11/2002 Teshigawara et al. ..... 347/43

FOREIGN PATENT DOCUMENTS

JP 2003-034021 A 2/2003

* cited by examiner

*Primary Examiner*—Lamson D. Nguyen
(74) *Attorney, Agent, or Firm*—Fitzpatrick, Cella, Harper & Scinto

(57) ABSTRACT

There is provided an ink jet printing apparatus that suppresses density unevenness caused by a difference in print time resulting from printing based on a bidirectional multi-pass printing system. With a relatively small print medium width, the time difference unevenness does not occur even in 2 pass printing. Accordingly, the 2 pass printing is selected. With a relatively large print medium width, selection of the 2 pass printing may make the density unevenness significant. Accordingly, the density unevenness is suppressed by selecting 8 pass printing. That is, in the 8 pass printing, the same area is scanned eight times, which is four times as frequent as the twice in the 2 pass printing. This reduces the size of each area having different densities, while increasing a cycle frequency at which a high and low densities are alternately repeated. As a result, the time difference unevenness is not perceived easily.

4 Claims, 31 Drawing Sheets

| | 8inch | 12inch | 24inch | 36inch | 44inch | 52inch | 60inch |
|---|---|---|---|---|---|---|---|
| NUMBER OF PRINT PASSES | 2 PASSES | 2 PASSES | 2 PASSES | 8 PASSES | 8 PASSES | 8 PASSES | 8 PASSES |

FIG.11

| | 8inch | 12inch | 24inch | 36inch | 44inch | 52inch | 60inch |
|---|---|---|---|---|---|---|---|
| 2 PASS PRINTING | 1 | 1 | 2 | 3 | 4 | 5 | 5 |
| 8 PASS PRINTING | 1 | 1 | 1 | 1 | 1 | 2 | 2 |

FIG.14

| | 8inch | 12inch | 24inch | 36inch | 44inch | 52inch | 60inch |
|---|---|---|---|---|---|---|---|
| EVALUATION MARK | 1 | 1 | 1 | 2 | 2 | 2 | 2 |

FIG.17

| | 8inch | 12inch | 24inch | 36inch | 44inch | 52inch | 60inch |
|---|---|---|---|---|---|---|---|
| FEEDING METHOD | NORMAL | NORMAL | NORMAL | SPECIAL FEEDING | SPECIAL FEEDING | SPECIAL FEEDING | SPECIAL FEEDING |

FIG.18

| | 8inch | 12inch | 24inch | 36inch | 44inch | 52inch | 60inch |
|---|---|---|---|---|---|---|---|
| 25inch/sec | 1 | 1 | 2 | 3 | 4 | 5 | 5 |
| 50inch/sec | 1 | 1 | 1 | 2 | 2 | 2 | 2 |

FIG.19

| | 8inch | 12inch | 24inch | 36inch | 44inch | 52inch | 60inch |
|---|---|---|---|---|---|---|---|
| CARRIAGE SPEED | 25inch/sec | 25inch/sec | 25inch/sec | 50inch/sec | 50inch/sec | 50inch/sec | 50inch/sec |

FIG.20

| | 8inch | 12inch | 24inch | 36inch | 44inch | 52inch | 60inch |
|---|---|---|---|---|---|---|---|
| EVALUATION MARK | 1 | 1 | 1 | 2 | 2 | 2 | 2 |

FIG.21

| | 8inch | 12inch | 24inch | 36inch | 44inch | 52inch | 60inch |
|---|---|---|---|---|---|---|---|
| DRYING MEANS | ABSENT | ABSENT | ABSENT | PRESENT | PRESENT | PRESENT | PRESENT |

FIG.22

| | 8inch | 12inch | 24inch | 36inch | 44inch | 52inch | 60inch |
|---|---|---|---|---|---|---|---|
| NUMBER OF PRINT PASSES | 2 PASSES | 2 PASSES | 2 PASSES | 8 PASSES | 8 PASSES | 8 PASSES | 8 PASSES |

FIG.24

| | 8inch | 12inch | 24inch | 36inch | 44inch | 52inch | 60inch |
|---|---|---|---|---|---|---|---|
| α(sec) | 0.5 | 0.7 | 1.2 | 1.6 | 2.0 | 2.3 | 2.6 |
| B(sec) | 0.2 | 0.2 | 0.2 | 0.2 | 0.2 | 0.2 | 0.2 |
| α−B(sec) | 0.3 | 0.5 | 1.0 | 1.4 | 1.8 | 2.1 | 2.4 |

FIG.25

| | 8inch | 12inch | 24inch | 36inch | 44inch | 52inch | 60inch |
|---|---|---|---|---|---|---|---|
| EVALUATION MARK | 1 | 1 | 2 | 3 | 4 | 5 | 5 |

FIG.26

| | 8inch | 12inch | 24inch | 36inch | 44inch | 52inch | 60inch |
|---|---|---|---|---|---|---|---|
| EVALUATION MARK | 1 | 1 | 1 | 1 | 1 | 2 | 2 |

FIG.27

| | 8inch | 12inch | 24inch | 36inch | 44inch | 52inch | 60inch |
|---|---|---|---|---|---|---|---|
| EVALUATION MARK | 1 | 1 | 1 | 1 | 1 | 2 | 2 |

FIG.30

| | 8inch | 12inch | 24inch | 36inch | 44inch | 52inch | 60inch |
|---|---|---|---|---|---|---|---|
| PRINT DIRECTION | BIDIRECTIONAL | BIDIRECTIONAL | BIDIRECTIONAL | BIDIRECTIONAL | ONE-DIRECTIONAL | ONE-DIRECTIONAL | ONE-DIRECTIONAL |

FIG.31

INK JET PRINTING APPARATUS AND INK JET PRINTING METHOD

BACKGROUND OF THE INVENTION

1. Field of the Invention

The present invention relates to an ink jet printing apparatus and an ink jet printing method, and more specifically, to a configuration that resolves an uneven density attributed to the difference in print time between passes which may occur during printing based on what is called a multi-pass printing system.

2. Description of the Related Art

As a printing apparatus in a printer, a copy machine, a facsimile machine, or the like or a printing apparatus used as equipment for outputting information processed by composite electronic equipment or a workstation including a computer, a word processor, or the like, an ink jet system-based printing apparatus is popular which can use a relatively simple configuration to print various print medium such as paper, cloths, plastic sheets, and OHP sheets. This system is basically of a non-contact printing type and does not depend on the type of print medium. Accordingly, a printing apparatus has been proposed which uses as print media not only those mentioned above which are normally used but also cloths, leathers, nonwoven cloths, and metals.

Further, such an ink jet printing apparatus mainly employs what is called a serial system that prints an image while scanning a print head in a direction (hereinafter referred to as a main scanning direction) crossing a direction (hereinafter referred to as a sub-scanning direction) in which print media are fed. The serial system-based printing apparatus has the advantage of being able to print images with a relatively high reproducibility and uniformity using a simple configuration. Moreover, as an ink ejecting system for the print head, there is what is called a bubble jet (registered mark) system that utilizes thermal energy generated by an electro-thermal converting element to generate bubbles in inks so that the pressure of the bubbles causes the inks to be ejected. The bubble jet system has widely been used because of its various advantages; ejection openings can be relatively densely arranged and noise generated in association with printing operations is low.

Further, recent ink jet printing apparatuses employ what is called a multi-pass printing system that improves an image grade by scanning the print head in the main scanning direction a number of times while varying ink ejection openings corresponding to the same print area on a print medium to complete printing that print area.

FIG. 1 is a diagram illustrating the multi-pass printing system. This figure shows multi-pass printing with two passes in which printing is completed by two main scans (hereinafter simply referred to as scans). FIG. 1 illustrates the multi-pass printing on the basis of the relationship between the position of a print head H and an area on a print medium P in which an image is printed. In this figure, an image is printed on the print medium P by causing the print head H to eject inks on the basis of print data, while moving the print head H in the main scanning direction (the direction of an arrow X1). Further, every time the print head H executes one scan, the print medium P is fed in the sub-scanning direction (the direction of an arrow Y) by a width (hereinafter referred to as a ½ band width) corresponding to half of the width of an arrangement of ejection openings in the print head H (hereinafter also referred to as the "width of the print head H"). FIG. 1 illustrates that the position of the print medium P is fixed and that the print head H moves in the direction opposite to the sub-scanning direction with respect to the print medium P.

With the multi-pass printing, during the first scan, printing is executed on the basis of print data obtained by thinning, to half, the pixels in image data for one band width corresponding to the width of the print head H. During the second scan, the print data for one band width is subjected to thinning complementary to the thinning for the first scan. Then, printing is executed on the basis of the print data obtained. Accordingly, the print medium P is printed by allowing the print head H to execute two scans each completing the print area for the half bandwidth. Specifically, for the print area on the print medium P which corresponds to the half band width, the first scan executes printing on the basis of the predetermined thinned print data. The second scan executes printing on the basis of the print data obtained by thinning complementary to the thinning in the first scan. In the description below, for two-pass printing, the first scan to complete printing the corresponding area is called a 1/2 pass. The second pass to complete printing the corresponding area is called a 2/2 pass. Further, for the print area on the print medium P which corresponds to the half bandwidth, an area subjected to only 1/2 pass printing is called a 1/2 pass print area. An area subjected to both 1/2 pass printing and 2/2 pass printing to complete the image is called a 2/2 pass print area.

FIG. 2 is a schematic diagram showing an image being printed by a two pass printing operation. During the printing operation, the print area for the half band width located at a trailing end of the print medium in the sub-scanning direction is a 1/2 pass print area. The 1/2 pass printing operation has executed only printing based on the thinned print data. Thus, the 1/2 pass print area has not been completely printed. If a thinning rate is, for example, half, the density of the area is about half of that accomplished on completion.

As is apparent from the description of the two pass printing system, multi-pass printing can basically be equally executed with any number of passes such as in 4 pass printing in which an image is completed by scanning the print head over the same print area on the print medium in the main scanning direction four times or 8 pass printing in which an image is completed by scanning the print head over the same print area on the print medium in the main scanning direction eight times.

However, with the above multi-pass printing system, when the time interval (herein after also referred to as print time difference) between the first scan and second scan executed on the same print area changes, the print density varies depending on the difference in print time. This may lead to the uneven density of the print image (hereinafter also referred to as time difference unevenness).

FIGS. 3A-3D and 4A-4D illustrate how the density becomes uneven depending on the print time difference.

FIGS. 3A-3D schematically illustrate how an ink permeates through and is fixed to a print medium 102 if there is a relatively small print time difference between the 1/2 pass and 2/2 pass of 2 pass printing. As shown in FIG. 3A, an ink droplet 101*a* is ejected during the 1/2 pass. The ink droplet permeates through the print medium 102 perpendicularly to the surface of the print medium 102 and along the surface as shown in FIG. 3B. Then, coloring materials such as dyes, that is, ink components, are physically and chemically bound to the print medium 102. Then, an ink droplet 101*b* ejected during the 2/2 pass as shown in FIG. 3C also permeates through the print medium 102 perpendicularly to the surface of the print medium 102 and along the surface as shown in FIG. 3D. However, the ink droplet 101*b* does not permeate well through or is not fixed well to the area in which the ink droplet 101*a* has already been fixed. This is because the ink droplet 101*a*, having already landed to the print medium, is still permeating through the print medium. Thus, the ink droplet 101*b*, which lands to the print medium later, permeates through the print medium to below the point to which the preceding ink droplet 101*a* has reached as shown in FIG. 3D. The ink droplet 101*b* is then fixed in this area. The landing or fixed position of the ink droplet 101*b* for the second pass, shown in FIGS. 3C and 3D, is misaligned with respect to the impacting or fixed position of the ink droplet 101*a* for the first pass, shown in FIGS. 3A and 3B. This is because in the multi-pass printing, the ink ejection data for the respective scans are complementary to each other on the basis of a pixel thinning process. A pixel landing to the print medium during the second pass is not the same as that impacting the print medium during the first pass. These pixels are, for example, adjacent to each other. This also applies to FIGS. 4A-4D.

FIGS. 4A-4D schematically illustrate how an ink permeates through and is fixed to the print medium 102 if there is a relatively large print time difference between the 1/2 pass and 2/2 pass of 2 pass printing compare to the case shown in the figure described above. As shown in FIG. 4A, the ink droplet 101*a* is ejected during the 1/2 pass. As shown in FIG. 4B, the ink droplet permeates through the print medium 102 perpendicularly to the surface of the print medium 102 and along the surface, similarly to the case shown in FIG. 3B. The coloring materials such as dyes, that is, the ink components, are physically and chemically bound to the print medium 102. Then, the ink droplet 101*b* ejected during the 2/2 pass and landing to the print medium later than the ink droplet 101*a* as shown in FIG. 4C permeates, at relatively large amount, through the print medium 102 to the area to which the preceding ink droplet 101*a* has permeated through and has been fixed (FIG. 4D), unlike in the case shown in FIG. 3D. This is because there is a relatively large print time difference between the 1/2 pass and the 2/2 pass, so that the ink droplet 101*a*, having already landed to the print medium, can sufficiently permeate and spread or its volatile components can be evaporated. As a result, the amount of ink droplet 101*a* per unit area of the print medium 102 decreases to enable the ink droplet 101*b*, which lands to the print medium later than the ink droplet 101*a*, to permeate through this area.

In this manner, the amount of ink fixed to the vicinity of the surface of the print medium, that is, the amount of coloring materials such as dyes, varies depending on the print time difference between the 1/2 pass and the 2/2 pass. The print density corresponds to the quantity of light absorbed by the coloring materials fixed to the vicinity of the surface of the print medium. Accordingly, the print density varies depending on the print time difference between the 1/2 pass and the 2/2 pass.

As described above, if an image is printed using the multi-pass printing system, when there is a difference in the print time difference between the 1/2 pass and the 2/2 pass, the time difference unevenness may occurs between the preceding print image and the current print image.

FIG. 5 is a diagram illustrating the relationship between the width of a print image (also simply referred to as the "print width" herein) that is a length over which the print head is scanned during bidirectional multi-pass printing and the print time difference between the 1/2 pass and the 2/2 pass. The print head H is scanned in the rightward direction of FIG. 5 during the first scan and in the leftward direction during the second scan, that is, bidirectional printing is executed during the first and second scans. Then, focus will be placed on an area A of a predetermined size located at the left end of the print image and an area B of a similar size located at the right end. In the area A at the left end, the 1/2 pass printing is executed as an early stage in which the print head H is scanned rightward. Then, the print head starts to return at the right end and then executes the 2/2 pass printing as a final stage in which the print head is scanned leftward. Thus, there is a relatively large print time difference between the 1/2 pass and the 2/2 pass. On the other hand, in the area B at the right end, the 1/2 pass printing is executed as the final stage in which the print head is scanned rightward. Then, the print head starts to return at the right end and then executes the 2/2 pass printing as the early stage in which the print head is scanned leftward. Thus, there is a relatively small print time difference between the 1/2 pass and the 2/2 pass. In an area such as the area A in which printing is executed in the final scan stage after the print head has started returning, the print time difference corresponds to the print width. Thus, the print time difference varies depending on the print width. As a result, the difference in density between the areas A and B increases consistently with the print width.

FIG. 6 is a diagram illustrating the unevenness of the density of (the unevenness of the time interval for) a print image caused by a variation in the print time difference between the area at the right end and the area at the left end in the scanning of the print head in the bidirectional multi-pass printing. In FIG. 6, an area in which there is a long print time difference between the 1/2 pass printing and the 2/2 pass printing is denoted by $\alpha$. An area in which there is only a short print time difference between the 1/2 pass printing and the 2/2 pass printing is denoted by B. The figure indicates that in the bidirectional printing, the area $\alpha$ alternates with the area B. The difference in density between these areas appears as a repetition of a high and low densities at the opposite ends of the print image. This is markedly perceived as time difference unevenness.

The above description relates to the 2-pass multi-pass printing. Of course, similar time difference unevenness may occur in multi-pass printing with three passes or more. In these cases, for example, in m (m equal to or greater than three) pass printing, a similar time difference unevenness may result not only from the time interval between a (m−1)/m pass printing operation and a m/m pass printing operation that completes the printing, but also from the time interval between a k/m pass printing operation and a (k+1)/m pass printing operation both performed before the printing is completed, the time interval corresponding to two consecutive scans. That is, the areas which have respectively become the areas $\alpha$ and B during the (k+1)/m pass become the areas B and $\alpha$, respectively, during the next (k+2)/m pass. However, the above time difference unevenness occurs during the (k+1)/m pass in accordance with the manner in which the ink permeates and is fixed. This density unevenness affects the final time difference unevenness of that area. For multi-pass printing with three or more passes, the final time difference unevenness on the completion of the printing creates a problem, similarly to the time difference unevenness during the scan.

The above time difference unevenness problem is significant in a printing apparatus that prints large-sized sheets. The recent ink jet printing apparatuses can print not only relatively small-sized print media such as an A4 and A3 sizes as in the conventional case but also relatively large-sized print media such as those having a width of 36, 42, 64, or 72 inches. In such a large-sized sheet printing apparatus, the difference in density between the areas A and B corresponds to the print width as described above in FIG. 5. Consequently, there is a larger difference in density between these areas, resulting in the remarkable occurrence of time difference unevenness.

Therefore, the time difference unevenness is a particularly serious problem for large-sized sheet ink jet printing apparatuses that can print relatively large-sized sheets.

Japanese Patent Application Laid-open No. 2003-034021 describes a known technique to suppress the time difference unevenness resulting from a print time difference as described above. According to this document, a print area is divided in a plurality of areas in the main scanning direction. Then, the numbers of dots of a black ink and other color inks applied to each area are counted. If there are any areas in which the numbers of dots of the black ink and other color inks exceed the respective thresholds, the number of such areas is counted. When the count has at least a predetermined value, it is determined that a density unevenness (corresponding to the above time difference unevenness) is likely to occur. Thus, a print mode is switched from bidirectional printing to one-directional printing. This makes it possible to suppress the time difference unevenness occurring at the opposite ends of the print medium. This document also contains the description that the width of image data printed, that is, the width of an area scanned by the print head, is detected and that when the width is small, it is determined that the degree of the time difference unevenness is small to avoid switching to the one-directional printing even if the number of areas has at least the predetermined value.

However, the technique to suppress the time difference unevenness, which technique is described in Japanese Patent Application Laid-open No. 2003-034021, basically determines the numbers of ink dots to determine whether or not time difference unevenness occurs in an area in which the numbers of ink dots have at least the predetermined values, so as to switch the scanning direction in accordance with the result of the determination. Thus, the amounts of load and data required for a process of counting the numbers of ink dots correspondingly increase. This results in the need for an extra time for processing. In particular, for an image to be printed on a large-sized sheet ink jet printing apparatus has an enormous amount of print data, the above problem is more serious.

SUMMARY OF THE INVENTION

It is an object of the present invention to provide an ink jet printing apparatus and an ink jet printing method which can suppress, without sharply increasing a processing load or the time required for processing, time difference unevenness resulting from a print time difference if printing is based on a bidirectional multi-pass system, even for a large-sized sheet ink jet printing apparatus that prints relatively large-sized sheets.

In the first aspect of the present invention, there is provided a printing apparatus which performs printing on a print medium by executing an operation of causing a print head to eject inks while scanning the print head over the same area of the print medium in a reciprocating manner, the print head having a plurality of ejection openings through which the inks are ejected, and an operation of feeding the print medium in a direction different from that in which the print head is scanned, the apparatus comprising:

obtaining means for obtaining information on the width of the print medium used for printing; and changing means for changing at least one of (a) a condition for the number of the scans, (B) a condition as to whether or not to perform an operation of feeding the print medium after a forward scan and before a backward scan, (C) a condition for a speed of the scans, (D) a condition as to whether or not to execute a drying process to facilitate drying of the inks ejected to the print medium, and (E) a condition for a direction of printing, in accordance with the information on the width of the print medium obtained by the obtaining means.

In the second aspect of the present invention, there is provided a printing apparatus which performs printing on a print medium by executing an operation of causing a print head to eject inks while scanning the print head over the same area of the print medium in a reciprocating manner, the print head having a plurality of ejection openings through which the inks are ejected, and an operation of feeding the print medium between a forward scan and a backward scan in a direction different from that in which the print head is scanned, the apparatus comprising:

obtaining means for obtaining information on the width of the print medium used for printing or a print width corresponding to print data; and changing means for changing the number of scans of the print head in accordance with the information obtained by the obtaining means, wherein if the information obtained by the obtaining means indicates a width equal to or larger than a predetermined value, the changing means increases the number of the scans.

In the third aspect of the present invention, there is provided a printing apparatus which performs printing on a print medium by executing an operation of causing a print head to eject inks while scanning the print head over the same area of the print medium in a reciprocating manner, the print head having a plurality of ejection openings through which the inks are ejected, and an operation of feeding the print medium in a direction different from that in which the print head is scanned, the apparatus comprising:

obtaining means for obtaining information on the width of the print medium used for printing or a print width corresponding to print data; and selecting means for selecting a condition for feeding of the print medium in accordance with the information obtained by the obtaining means, wherein if the information obtained by the obtaining means indicates a width smaller than a predetermined value, the changing means selects a condition that the print medium is fed between a forward scan and a backward scan, and if the information obtained by the obtaining means indicates a width equal to or larger than the predetermined value, the changing means selects a condition that the print medium is not fed after the forward scan and before the backward scan but is fed after the backward scan and before the forward scan.

In the fourth aspect of the present invention, there is provided a printing apparatus which performs printing on a print medium by executing an operation of causing a print head to eject inks while scanning the print head over the same area of the print medium in a reciprocating manner, the print head having a plurality of ejection openings through which the inks are ejected, and an operation of feeding the print medium in a direction different from that in which the print head is scanned, the apparatus comprising:

obtaining means for obtaining information on the width of the print medium used for printing or a print width corresponding to print data; and changing means for changing a speed of scanning of the print head in accordance with the information obtained by the obtaining means, wherein if the information obtained by the obtaining means indicates a width equal to or larger than a predetermined value, the changing means increases the speed of the scanning.

In the fifth aspect of the present invention, there is provided a printing apparatus which performs printing on a print medium by executing an operation of causing a print head to eject inks while scanning the print head over the same area of the print medium in a reciprocating manner, the print head having a plurality of ejection openings through which the inks are ejected, and an operation of feeding the print medium in a direction different from that in which the print head is scanned, the apparatus comprising:

obtaining means for obtaining information on the width of the print medium used for printing or a print width corresponding to print data; and selecting means for selecting a condition for a drying process for facilitating drying of the inks ejected to the print medium, in accordance with the information obtained by the obtaining means, wherein if the information obtained by the obtaining means indicates a width smaller than a predetermined value, the selecting means selects a condition that the drying process is not executed, and if the information obtained by the obtaining means indicates a width equal to or larger than the predetermined value, the selecting means selects a condition that the drying process is executed.

In the sixth aspect of the present invention, there is provided an ink jet printing apparatus which execute a bidirectional print mode in which a print medium is printed by both a forward scan and a backward scan of a print head having a plurality of ejection openings through which inks are ejected, and an one-directional print mode in which the print medium is printed by one of the forward scan and backward scan of the print head, the apparatus comprising:

obtaining means for obtaining information on the width of the print medium used for printing; and selecting means for selecting the print mode used for the printing in accordance with the information obtained by the obtaining means, wherein if the information obtained by the obtaining means indicates a width smaller than a predetermined value, the selecting means selects the bidirectional print mode, and if the information obtained by the obtaining means indicates a width equal to or larger than the predetermined value, the selecting means selects the one-directional print mode.

In the seventh aspect of the present invention, there is provided a printing method of performing printing on a print medium by executing an operation of causing a print head to eject inks while scanning the print head over the same area of the print medium in a reciprocating manner, the print head having a plurality of ejection openings through which the inks are ejected, and an operation of feeding the print medium in a direction different from that in which the print head is scanned, the method comprising the steps of:

a step of obtaining information on the width of the print medium used for printing; and a step of changing at least one of (a) a condition for the number of the scans, (B) a condition as to whether or not to execute an operation of feeding the print medium after a forward scan and before a backward scan, (C) a condition for a speed of the scans, (D) a condition as to whether or not to execute a drying process to facilitate drying of the inks ejected to the print medium, and (E) a condition for a direction of printing, in accordance with the information on the width of the print medium obtained in the obtaining step.

According to the present invention, when the width of the print medium or the print width is large and density unevenness (time difference unevenness attributed to an increase in print time difference between the opposite ends in a scan direction in a band) occurs such that for example, a scan area (band) with a high density and a scan area (band) with a low density are alternately repeated at the right and left ends of the print medium in the sub-scanning direction, the process of reducing the time difference unevenness (for example, a process of increasing the number of scans of the print head, a process of feeding the print medium only after a backward scan without feeding the print medium after a forward scan, a process of increasing the scan speed of the print head, a process of drying the print medium by heat or the like, or a process of switching to the one-directional print mode) is executed. This prevents the alternate repetition of a scan area (band) with a high density and scan area (band) with a low density at the right and left ends of the print medium. Therefore, the time difference unevenness can be suppressed.

As a result, it is possible to suppress, without sharply increasing the processing load or the time required for processing, the time difference unevenness resulting from the print time difference if printing is based on a bidirectional multi-pass system, even for a large-sized sheet ink jet printing apparatus that prints relatively large-sized sheets.

The above and other objects, effects, features and advantages of the present invention will become more apparent from the following description of embodiments thereof taken in conjunction with the accompanying drawings.

BRIEF DESCRIPTION OF THE DRAWINGS

FIG. 11 is a diagram schematically showing a table referenced to determine the number of print passes in the print control shown in FIG. 10;

FIG. 14 is a diagram showing the evaluation of images for the relationship between the width of the print medium and the occurrence of time difference unevenness in 2-pass printing and 8-pass printing;

FIG. 17 is a diagram showing the evaluation of images for the relationship between the width of the print medium and the occurrence of time difference unevenness observed if the special feeding is executed;

FIG. 18 is a diagram showing a table referenced to determine conveyance control according to the second embodiment;

FIG. 19 is a diagram showing the evaluation of images for the relationship between the width of the print medium and the occurrence of time difference unevenness observed if the movement speed of the carriage is changed, according to a third embodiment of the present invention;

FIG. 20 is a diagram showing a table referenced to determine the movement speed of the carriage according to the third embodiment;

FIG. 21 is a diagram showing the evaluation of images for the relationship between the width of the print medium and the occurrence of time difference unevenness observed if a drying process is executed, according to a fourth embodiment of the present invention;

FIG. 22 is a diagram showing a table referenced to determine whether or not to execute a drying process according to the fourth embodiment;

FIG. 24 is a diagram showing a table referenced to determine the number of print passes according to the sixth embodiment;

FIG. 25 is a diagram showing the relationship between a difference in print time and the print width observed during 2 pass printing;

FIG. 26 is a diagram showing the evaluation of images for the relationship between the width of the print medium and the occurrence of time difference unevenness in 2-pass printing;

FIG. 27 is a diagram showing the evaluation of images for the relationship between the width of the print medium and the occurrence of time difference unevenness in 8-pass printing;

FIG. 30 is a diagram showing the evaluation of images for the relationship between the width of the print medium and the occurrence of time difference unevenness in unidirectional printing; and FIG. 31 is a diagram showing a table referenced to determine a print direction according to a seventh embodiment of the present invention.

DETAILED DESCRIPTION OF PREFERRED EMBODIMENTS

Embodiments of the present invention will be described below in detail with reference to the drawings.

Figure 7:
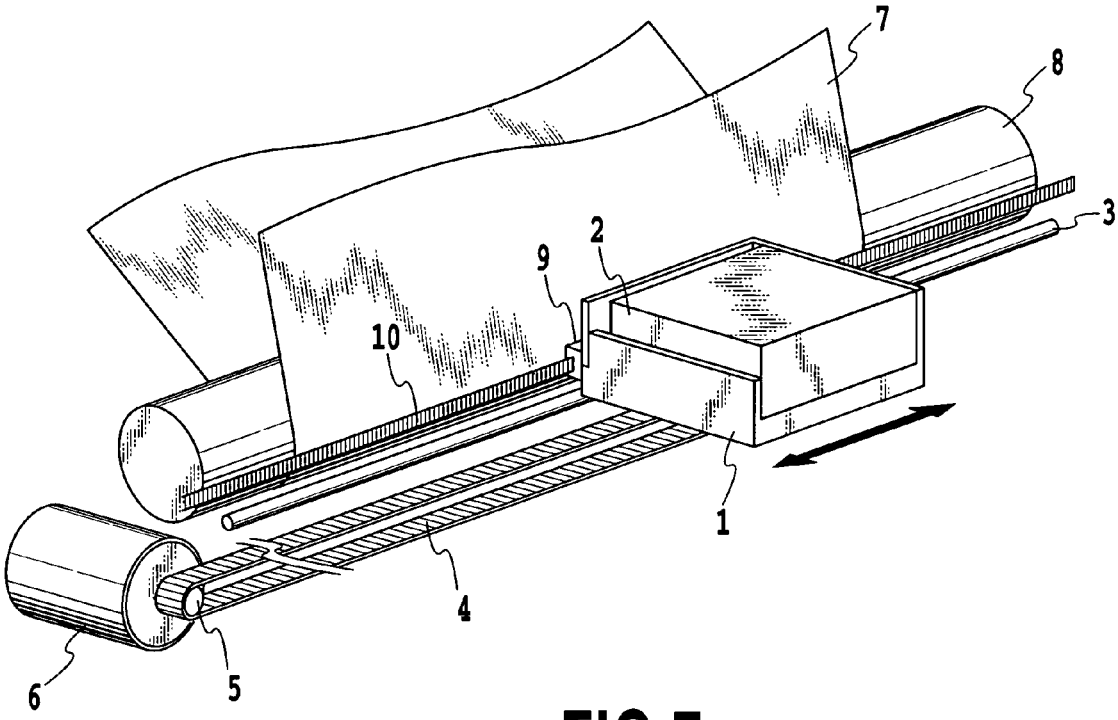
FIG. 7 is a perspective view schematically showing the internal configuration of a large-sized sheet ink jet printing apparatus with a maximum print width of 64 inches according to an embodiment of the present invention.

FIG. 7 is a schematic perspective view showing the internal configuration of a large-sized sheet ink jet printing apparatus with a maximum print width of 64 inches according to an embodiment of the present invention.

In FIG. 7, a print head 2 is removably mounted on a carriage 1. The carriage 1 is supported by a guide shaft so as to be movable along a guide shaft 3. A part of a carriage belt 4 is fixed to the carriage 1. On the other hand, the carriage belt 4 is extended between two motor pulleys 5 (one of them is not shown). A main scanning motor 6 drives and rotatively moves the carriage belt 4 to allow the carriage 1 to move along the guide shaft 3. The movement of the carriage 1 enables the print head 7 to be scanned over a print medium 7. The print medium 7 is fed in a sub-scanning direction as a conveying roller 8 is rotated by a driving motor (not shown). By controlling the amount of rotation of the conveying roller, it is possible to control the feeding amount of print medium 7 in multi-pass printing according to the present embodiment.

The carriage 1 is provided with an encoder sensor 9. The encoder sensor 9 can detect the position of the carriage 1, a scan speed, or the like by detecting a scale on a linear encoder scale 10 extending parallel to the guide shaft 3. The present embodiment employs an optical encoder and the linear encoder scale 10 is provided with the scale on a transparent film at predetermined pitch intervals. The encoder sensor 9 is composed of a photo interrupter to detect the scale provided at the predetermined pitch intervals and thus an encoder pulse signal corresponding to this pitch. Then, on the basis of this encoder pulse signal, a scan position of the print head is controlled to provide a scan range corresponding to a print width as described later in FIG. 10 and subsequent figures. The encoders 9 and 10 are not limited to an optical type but may be of a magnetic type.

Figure 8:
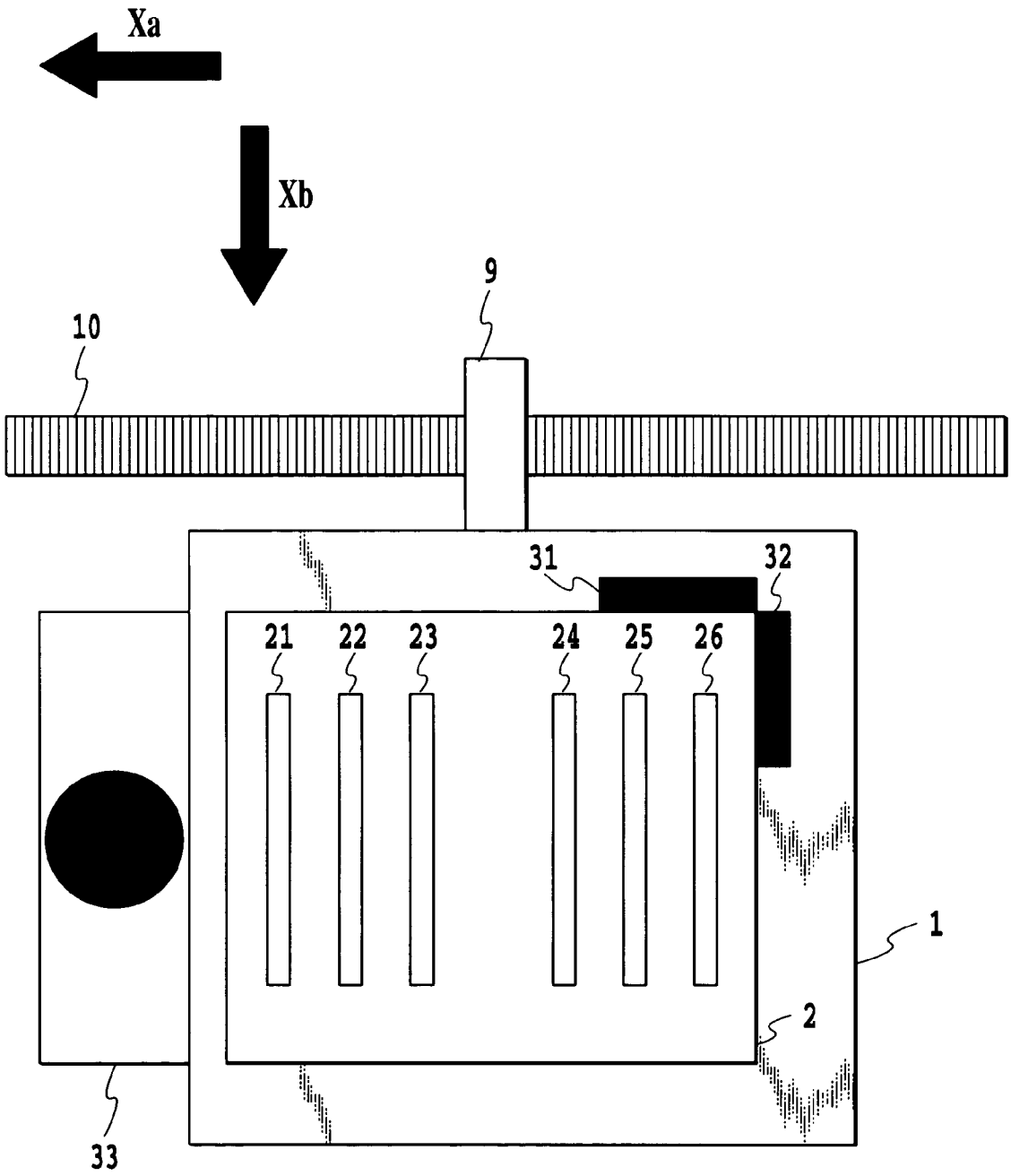
FIG. 8 is a diagram schematically showing an arrangement in which a print head is mounted on a carriage in FIG. 7 and associated arrangements.

FIG. 8 is a diagram schematically showing the carriage 1 on which the print head is mounted.

As shown in FIG. 8, the print head 2 is composed of six head chips 21 to 26. The head chip 21 ejects a black (hereinafter also referred to as Bk) ink, and the head chip 22 ejects a light cyan (hereinafter referred to as Pc) ink. The head chip 23 ejects a cyan (hereinafter referred to as C) ink, and the head chip 24 ejects a magenta (hereinafter referred to as M) ink. The head chip 25 ejects a light magenta (hereinafter referred to as Pm) ink, and the head chip 26 ejects a yellow (hereinafter referred to as Y) ink. Each of these head chips comprises, for example, 256 ejection openings. The head chips are driven by a head driver (not shown) on the basis of print data to eject the inks from the respective ejection openings. The head chips are driven by applying electric pulses to electro-thermal converting elements provided at ink paths in the respective ejection openings. Thus, bubbles are generated in the inks and the pressure of the bubbles enables the inks to be ejected.

The linear encoder scale 10 is placed along a main scanning direction Xa of the carriage 1. The carriage 1 is provided with the encoder sensor 9 to detect the scale on the linear encoder scale 10. Further, the carriage 1 is provided with a positioning member 31 that positions the print head 2 in the main scanning direction Xa of the carriage 1 and a positioning member 32 that positions the print head 2 in a sub-scanning direction Xb. When mounted on the carriage 1, the print head 2 can be positioned in the respective directions by being abutted against the positioning members 31 and 32. A print medium width sensor 33 is also attached to the carriage 1. The print medium width sensor 33 is used to detect the width of a print medium.

Figure 9:
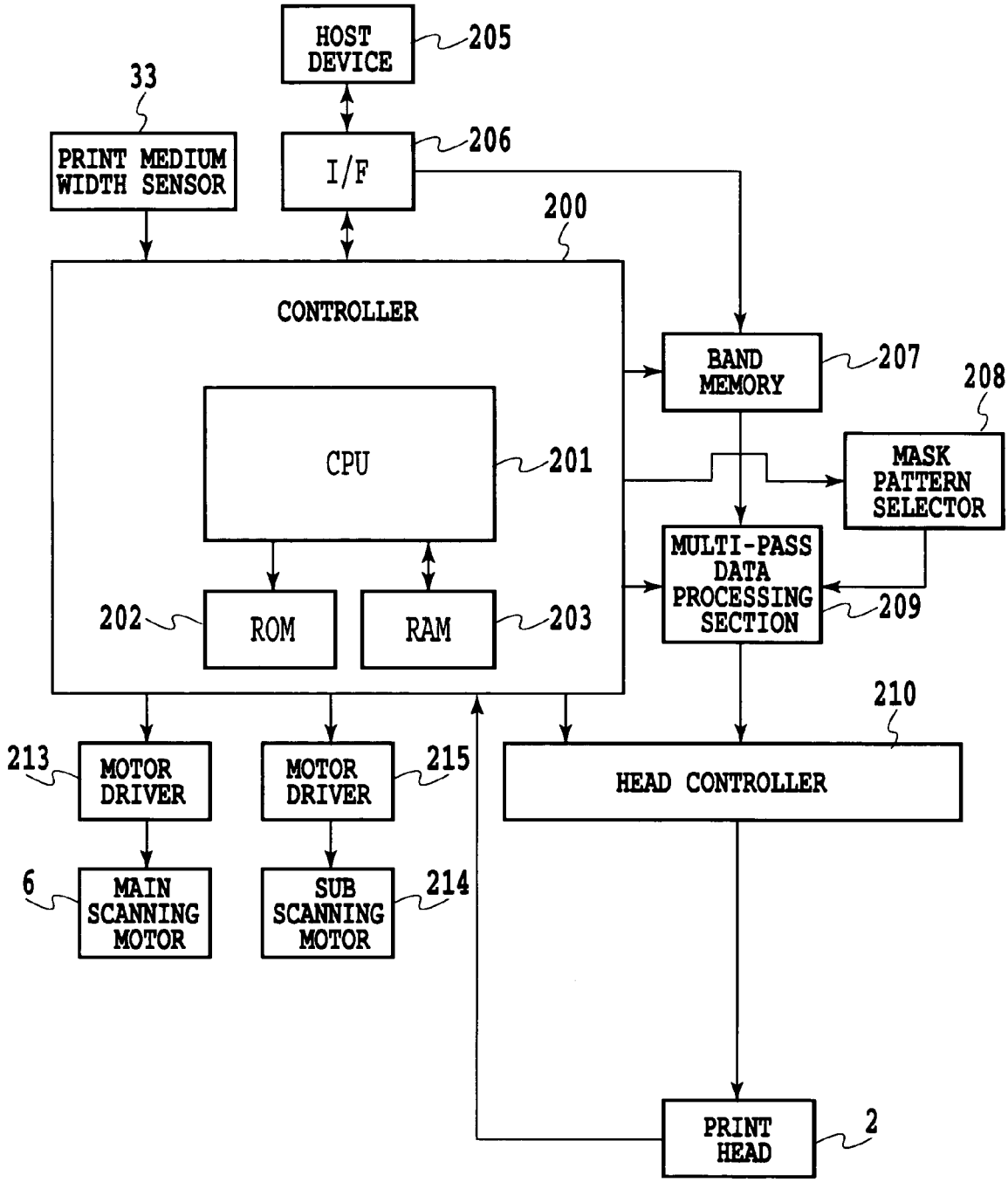
FIG. 9 is a block diagram showing the configuration of a control system in the ink jet printing apparatus shown in FIG. 7.

FIG. 9 is a block diagram showing the configuration of a control system in the ink jet printing apparatus shown in FIG. 7.

In FIG. 9, reference numeral 200 denotes a controller serving as a main control section. The controller has a CPU 201 in microcomputer form which executes processes such as the one shown in FIG. 10, described later, a ROM 202 that stores programs and tables corresponding to procedures of executing the sequences of the processes, as well as the voltage value and pulse width of a head pulse and other fixed data, and a RAM 203 provided with, for example, an area in which print data is expanded and a work area. Reference numeral 33 denotes the sensor shown in FIG. 8 and which senses the width of a print medium. An output value from the print medium width sensor is inputted to the controller 200. Further, reference numeral 205 denotes a host device serving as a source of print data. Print data, commands, status signals, and the like from the host device 205 are transmitted between the controller 200 and a band memory 207 via an interface (I/F) 206.

Figure 1:
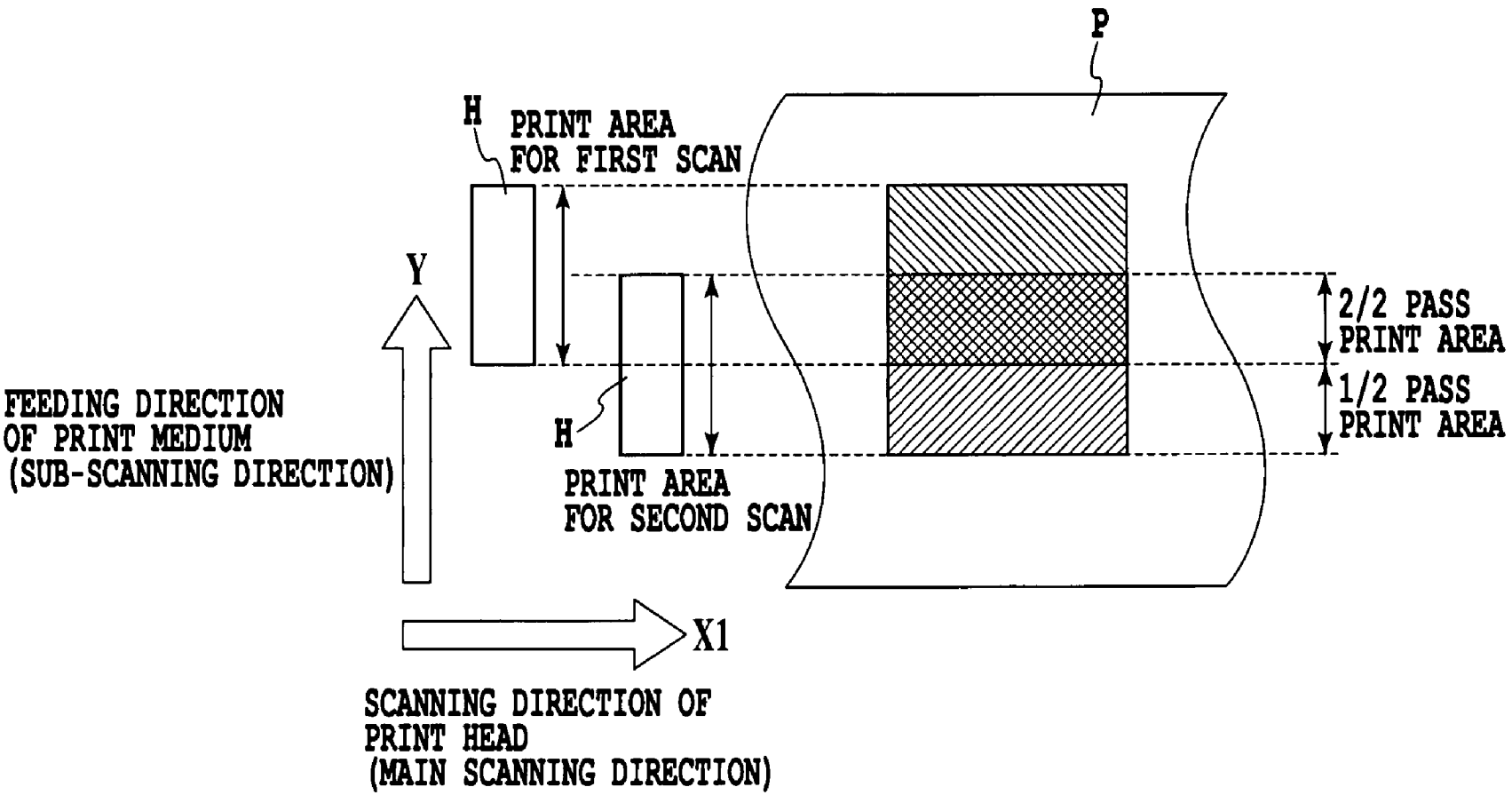
FIG. 1 is a schematic diagram showing the relationship between a head position and a print image observed if 2 pass printing is executed as multi-pass printing.
Figure 2:
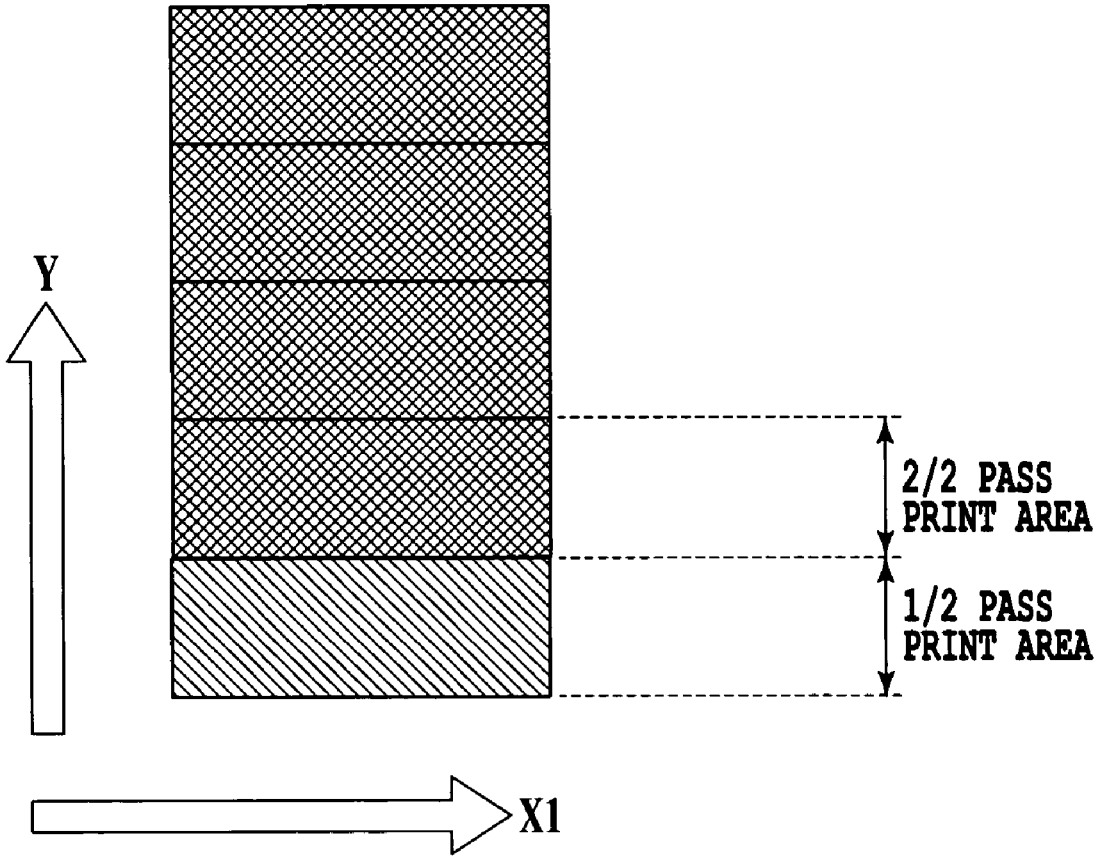
FIG. 2 is a schematic diagram showing the state of printing before completion observed if the 2 pass printing is executed.
Figure 3A:
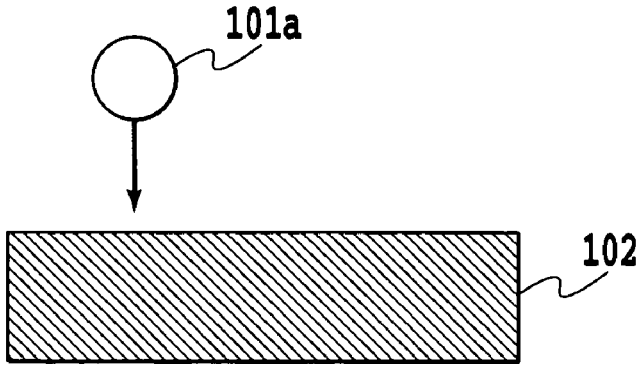
FIGS. 3A to 3D are diagrams illustrating how an ink permeate through and is fixed to a print medium if there is only a small difference in print time between a 1/2 pass and a 2/2 pass.
Figure 3B:
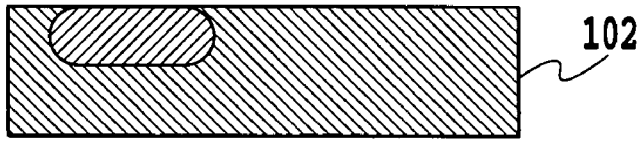
Figure 3C:
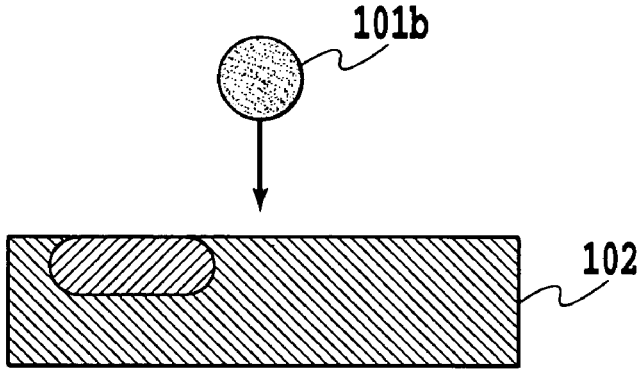
Figure 3D:
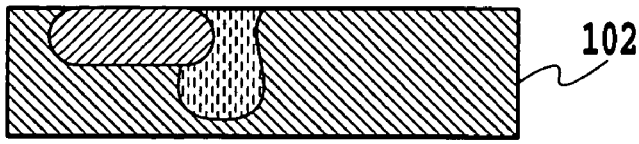
Figure 4A:
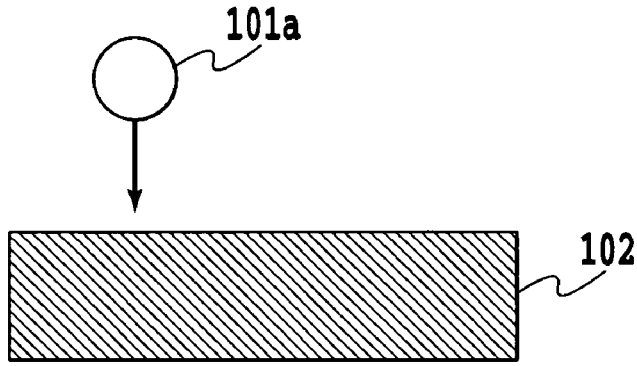
FIGS. 4A to 4D are diagrams illustrating how the ink permeate through and is fixed to the print medium if there is a large difference in print time between a 1/2 pass and a 2/2 pass compared to FIGS. 3A to 3D.
Figure 4B:
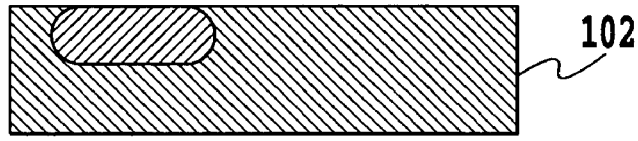
Figure 4C:
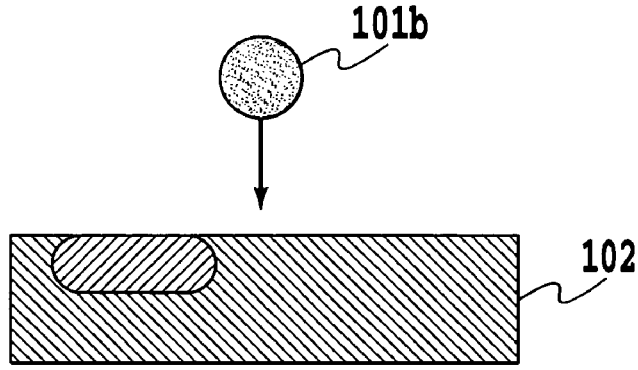
Figure 4D:
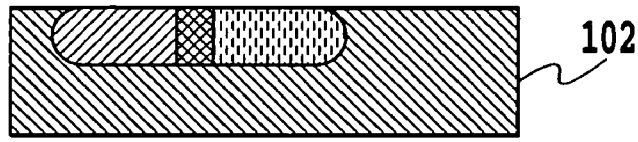
Figure 5:
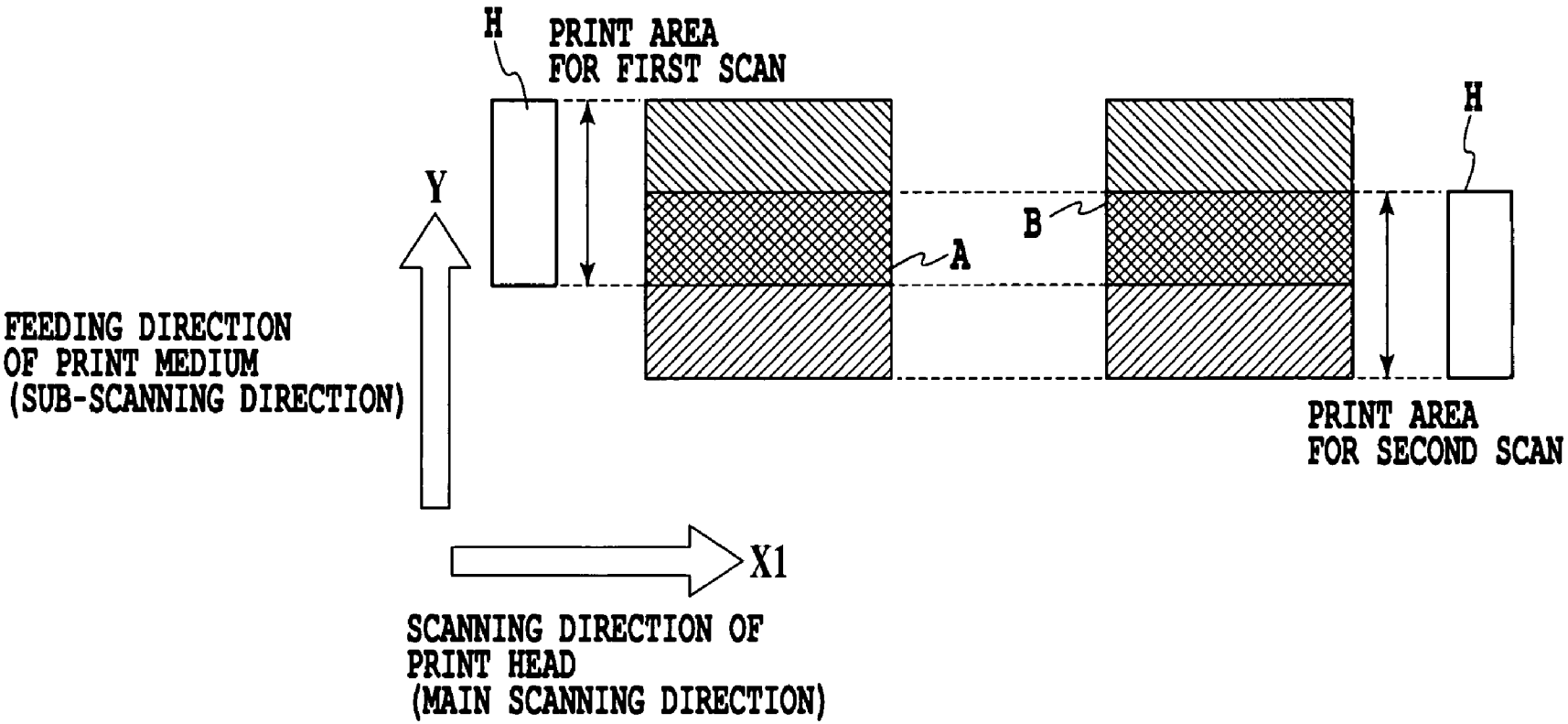
FIG. 5 is a diagram illustrating the width of a print image and the difference in print time between the 1/2 pass and the 2/2 pass.

Reference numeral 208 denotes a mask pattern selector controllably connected to the CPU 201 to provide an output that is inputted to a multi-pass data processing section 209. Reference numeral 207 denotes a band memory. Image data for printing is transferred from the interface 206 to the band memory 207. The CPU 201 performs control such that image data required to print each print area of a predetermined width into which the original image data has been divided is stored in the band memory as print data for one band (one scan of the print head for each color ink). An output from the band memory 207 is inputted to the multi-pass data processing section 209. The multi-pass data processing section 209 executes thinning process for the image data so as to complete printing each divided print area using a plurality of scans. The multi-pass data processing section 209 then generates print data for one scan and outputs it to a head driver 210. For printing or preliminary ejection, the electro-thermal converting elements (ink ejecting heaters) of the print head 2 are driven in accordance with the print data. The print head 2 is controlled by the head driver 210 to eject the ink from the ejection openings synchronously with the movement of the carriage 1. The print head 2 can thus execute printing for one scan. Reference numeral 6 denotes the main scanning motor described above in FIG. 1 and which serves as a driving source for moving the carriage 1 in the main scanning direction. Reference numeral 213 denotes a driver for the main scanning motor. Further, reference numeral 214 denotes a sub-scanning motor serving as a driving source for conveying a print medium such as a print sheet in the sub-scanning direction. Reference numeral 215 denotes a driver for the sub-scanning motor.

Embodiment 1

Figure 10:
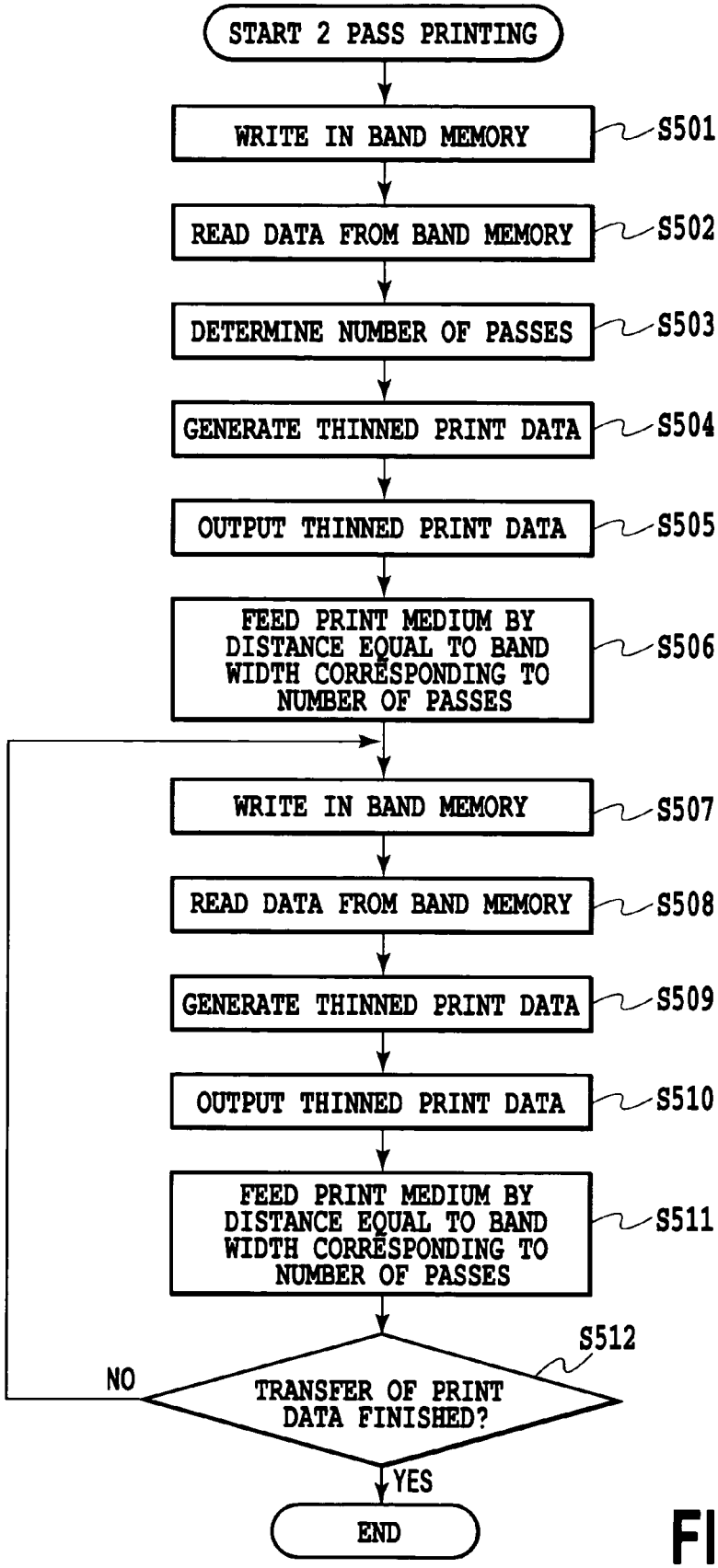
FIG. 10 is a flow chart showing a procedure of print control according to a first embodiment of the present invention.

FIG. 10 is a flow chart showing a procedure of printing operation according to a first embodiment of the present invention.

In FIG. 10, the host device 205 first inputs a print instruction command and print data to the CPU 201 via the interface 206. The CPU 201 then writes print data for one band in the band memory 207 (step S501). Then, the multi-pass data processing section 209 reads all the image data for one band from the band memory 207.

Then, the CPU 201 obtains information on the width of a print medium used for printing. The CPU 201 then determines the number of passes in multi-pass printing on the basis of the information obtained on the width of the print medium (step S503). More specifically, the CPU 201 references a table described later in detail in FIG. 11 on the basis of the information obtained on the width of the print medium. The CPU 201 thus selects a 2- or 8-pass multi-pass print mode as a print mode. The information on the width of the print medium may also be obtained by using the print medium width sensor 33 to detect the width of the print medium. Further, the width may also be determined on the basis of size information on the print medium sent by the host device together with print data, rather than being detected by the sensor.

In the present embodiment, the width of the print medium is determined. When the width determined is equal to or greater than a predetermined value, the range of scan by the print head increases consistently with the width. Accordingly, the number of passes in multi-pass printing is increased to make time difference unevenness less noticeable.

FIG. 11 is a table showing the relationship between the number of passes and the width of the print medium used to determine the number of passes (step S503). The present embodiment uses 8 pass printing when the print medium has a relatively large width and 36 inches or more, and uses 2 pass printing when the print medium has a relatively small width and 24 inches or less. When the width of the print medium to be determined is not associated with the table, the number of passes is determined in association with the most similar width of the print medium in the table.

Then, in steps S504 to S506, print data is generated by thinning, a printing operation is performed by outputting print data, and the print medium is fed. These processes correspond to the number of passes determined as described above.

First, in the step S504, the multi-pass data processing section 209 executes a thinning process corresponding to the number of passes determined. For example, a thinning process for the 2 pass printing is executed on image data read from the band memory 207 using mask patterns shown in FIGS. 12A and 12B. The checker pattern shown in FIG. 12A is used for the first pass of the 2 pass printing as a mask pattern for thinning print data.

Figure 12B:
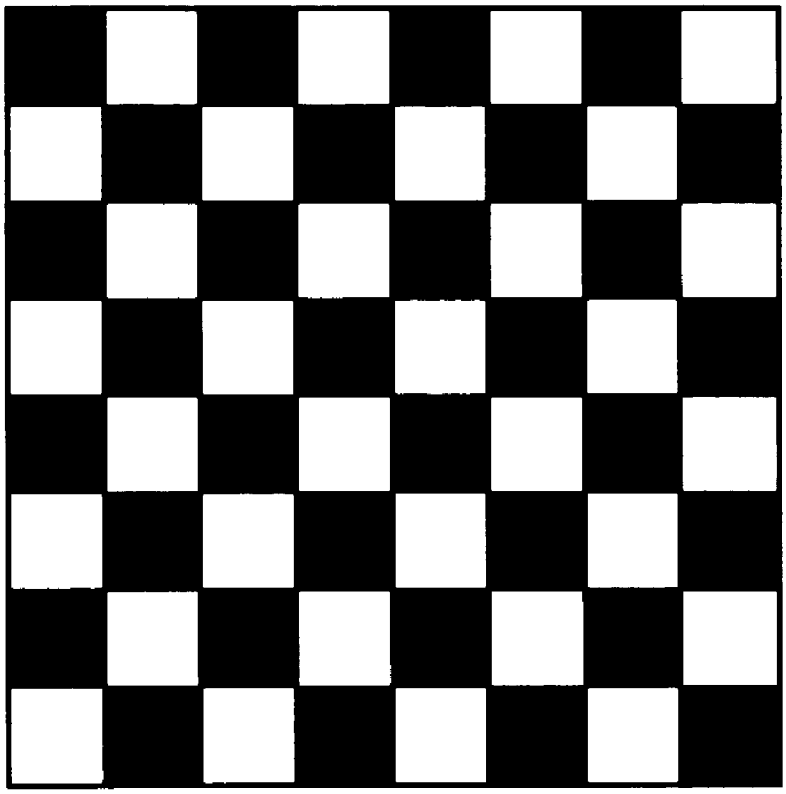
FIGS. 12A and 12B are diagrams showing an example of a mask pattern used in 2-pass multipass printing.
Figure 12A:
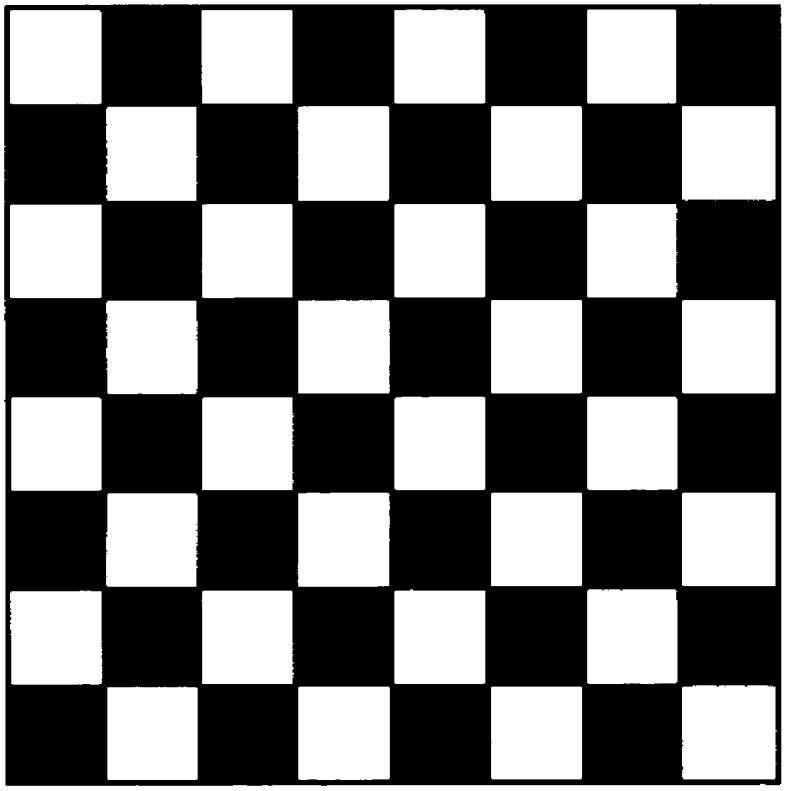
Figure 13:
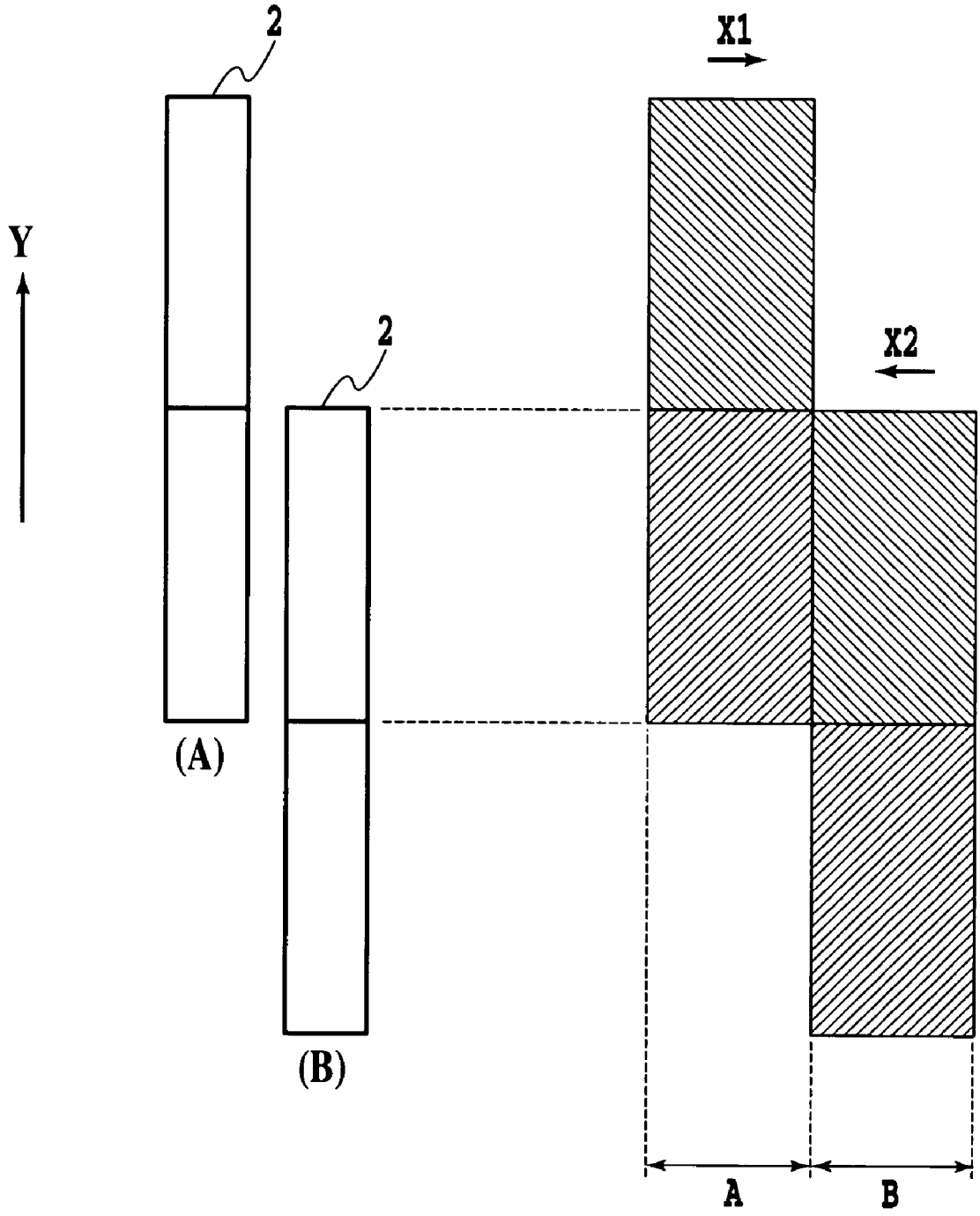
FIG. 13 is a diagram showing the positional relationship between a print head and a print medium in 2-pass multipass printing.

The reverse checker pattern shown in FIG. 12B is used for the second pass executed after the feeding of the print medium in the step S506, as a mask pattern for thinning print data. FIG. 13 is a diagram showing the positional relationship between the print head and the print medium in the 2-pass printing. In reciprocative scanning according to the present embodiment, for example, during the first scan, the print head 2 is scanned forward in a direction X1 in FIG. 13. During the second scan, the print head 2 is scanned backward in a direction X2 in FIG. 13.

Then, in the step S505, the CPU outputs the print data generated by thinning in the step S504 to the head controller 210. Further, the CPU causes the print head 2 to eject ink while scanning the carriage 1 in the main scanning direction, to print an image on the print sheet. That is, on the basis of the print data generated using the predetermined thinning pattern in the step S504, the print head 2 ejects the ink while being scanned forward in the direction X1, to print a thinned image all over the area for one scan, as shown in a stage A shown in FIG. 13.

Then, in the step S506, the print medium is conveyed by an amount corresponding to the number of passes determined in the step S503. For example, for the two pass printing, the print sheet is conveyed in the sub-scan direction of an arrow Y by an amount corresponding to a half band width. As shown in FIG. 13, in the step S506, the print head 2 lies at a position B offset from the position A by the half band width.

Then, while it is determined in the step S512 that the printing of one page has not been finished, print data for one band inputted by the host is written in the band memory 207 for each scan (step S507). All the print data for one band is read from the band memory 207 (step S508). Then, a printing operation is performed by executing a thinning process corresponding to the number of passes set in the step S503 to generate print data. The print medium is then fed in association with the set number of passes (steps S509 to S511). Then, when the printing of one print sheet is completed, the present process is ended (step S512).

FIG. 14 is a diagram showing the evaluation of images for the relationship between the width of the print medium and the occurrence of time difference unevenness in 2-pass printing and 8-pass printing. A five-ranking sensory evaluation is used as an evaluation method. The contents of the evaluation are described below.

5 points: fatal image defect 4 points: not fatal but critical defect 3 points: minor defect 2 points: almost no image defects 1 point: no image defects As shown in FIG. 14, in the 2 pass printing, the larger the width of the print medium is, the more significant the time difference unevenness is. On the other hand, in the 8 pass printing, the time difference unevenness is not so significant even with the increased width of the print medium.

Thus, in the print control described above in FIG. 10, the table shown in FIG. 11 is used to select the number of passes corresponding to the width of the print medium.

As shown in FIG. 11, with a relatively small print medium width, the time difference unevenness does not occur even in the 2 pass printing. Accordingly, the 2 pass printing, which improves throughput, is selected. With a relatively large print medium width, selection of the 2 pass printing may make the time difference unevenness significant. Accordingly, the significant time difference unevenness can be suppressed by selecting the 8 pass printing.

Specifically, in the 8 pass printing, the same area is scanned eight times, which is four times as frequent as the twice in the 2 pass printing. This reduces the size of each of the areas α and B, while increasing a cycle frequency at which these areas are alternately repeated. As a result, the time difference unevenness is not perceived easily. In this manner, even with the same print width, the time difference unevenness can be made less noticeable by increasing the number of passes.

In the above example, the number of print passes is selected from the 2 pass printing and the 8 pass printing. However, as is apparent from the above description, similar effects can be produced regardless of the set number of print passes; for example, one of three values including six passes may be selected, or either eight or twelve passes may be selected.

As described above, in the present embodiment, by selecting the number of passes depending on the width of the print medium in the bidirectional multi-pass printing, it is possible to suppress the time difference unevenness attributed to bidirectional printing.

It should be noted that the number of passes may be set to be a large number such as eight passes even when the width of print medium is small, so as to place priority on print quality, even though the above described embodiment selects the number of passes depending on the width of the print medium. The number of passes may be selected from a plurality of number of passes depending on a print mode to be carried out preferentially such as a mode for print quality and a mode for a print speed, and the selective number of passes may be more suppressed when the larger width of print medium is used. This configuration can also suppress the time difference unevenness when the relatively large width of print medium is used.

Embodiment 2

In the present embodiment, the feeding of the print medium in the bidirectional printing is controlled to avoid varying the print time difference between the opposite ends of the scan area. The time difference unevenness is thus suppressed.

Figure 15:
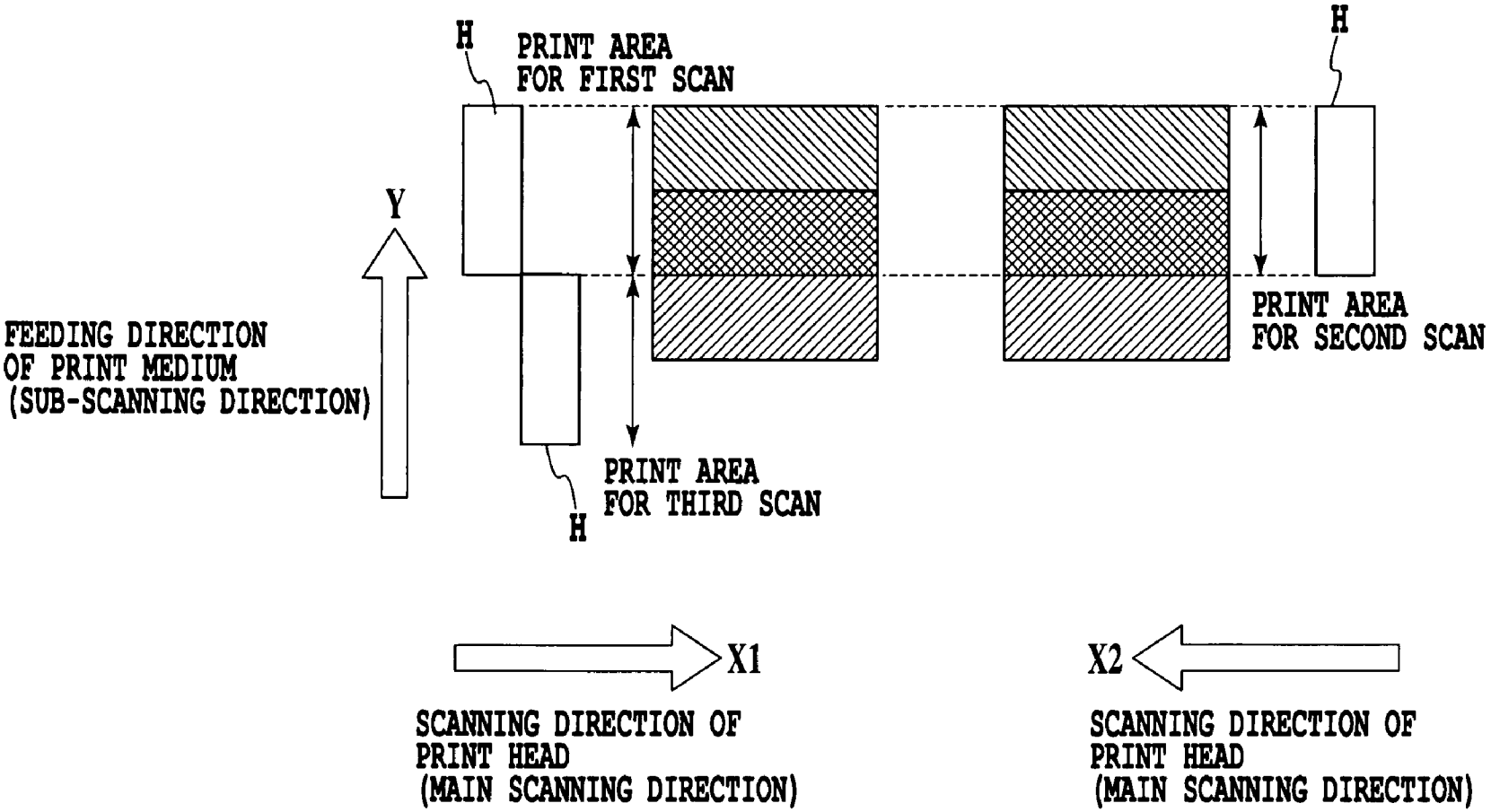
FIG. 15 is a diagram illustrating print control including special feeding with a changed conveyance amount in multi-pass printing according to a second embodiment of the present invention.

FIG. 15 is a diagram illustrating a printing method used if the fed amount is changed (this change will hereinafter be referred to as special feeding) in the 2 pass printing according to a second embodiment of the present invention. FIG. 15 shows the relationship between the position of the print head H and the print area of an image printed on the print medium P.

In FIG. 15, an image or the like is printed in a print area for the first scan by causing the print head H to eject the ink on the basis of print data while moving the print head H in the main scanning direction (the direction of the arrow X1). The present embodiment performs control such that after printing by a forward scan, the print medium is not fed before a backward scan. Then, an image is printed in a print area for the second scan, which is the same as the area for the first scan, by causing the print head H to eject the ink on the basis of the print data while moving the print head H in the main scanning direction that is the backward direction (the direction of the arrow X2). Then, once the second scan is finished, the print medium is fed in the sub-scanning direction (the direction of the arrow Y) by a distance corresponding to one band width. In this manner, when the 2N-1-th (N is a natural number) scan is finished, the print medium is not fed but the same ejection openings are used to print the same area. Then, when the 2N-th scan is finished, the print medium is fed by a distance corresponding to one band width. In this case, during the 2N-1-th scan, printing is executed on the basis of print data obtained by thinning print data at a predetermined pattern from print data for one band with corresponding to the width of a row of ejection openings in the print head H. During the 2N-th scan, printing is executed on the basis of print data obtained by thinning complementary to the thinning for the 2N-1-th scan.

In the print control according to the present embodiment, in the step S503 of the process in FIG. 10, shown in connection with the first embodiment, the width of the print medium is detected. Then, a table described later in FIG. 18 is referenced to determine whether or not to execute the above described special feeding print mode, on the basis of the detected width of the print medium. If the special feeding is determined to be executed, the feeding of the print medium is controlled in the step S506 so that the print medium is not fed after the 2N-1-th (N is a natural number) scan has been finished. In the feeding control according to the present embodiment, if the feeding is switched between the normal type and the special feeding, then of course, when print data is generated in the step S504, ejection openings used are set on the basis of an area with which ejection openings in the print head are associated in connection with the switching so that the print data can be associated with the ejection openings used.

Figure 16:
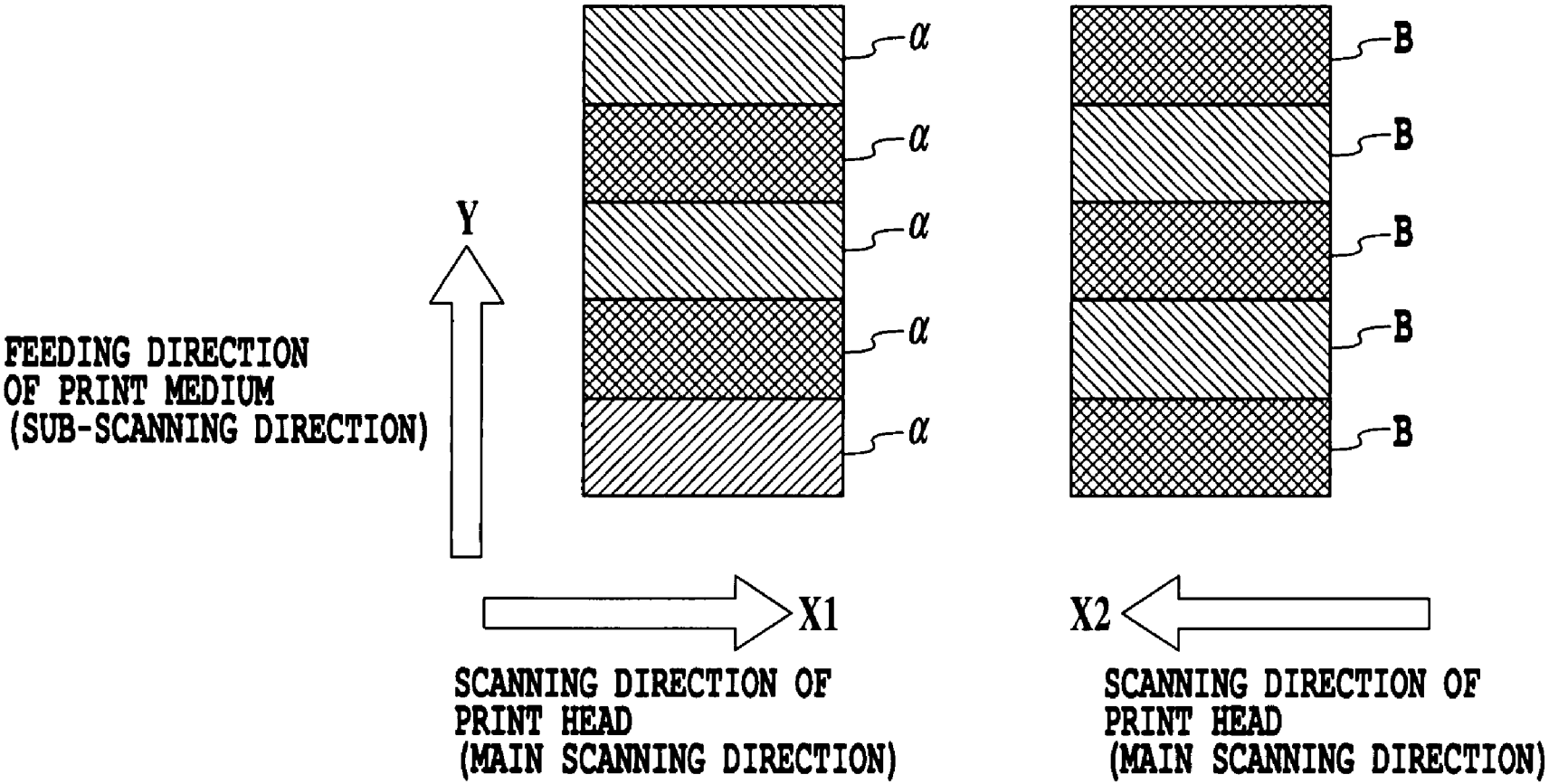
FIG. 16 is a diagram illustrating a difference in print time occurring if the special feeding is executed.

FIG. 16 is a diagram illustrating a print time difference occurring if the special feeding is executed in the bidirectional 2-pass printing, as well as the resulting difference in density. As in the case of FIG. 6, reference sign α is used if there is a large print time difference between the printing of the 1/2 pass print area and the printing of the 2/2 pass print area. Reference sign B is used if there is only a small print time difference between the printing of the 1/2 pass print area and the printing of the 2/2 pass print area. As shown in FIG. 16, all the areas at the left end are denoted by α, while all the areas at the right end are denoted by B. Accordingly, there is time difference unevenness between the left end and the right end, but at both left and right ends, there is no time difference unevenness between areas adjacent to each other in the sub-scanning direction. It is thus possible to sharply reduce the time difference unevenness, involving alternately repeated dark- and light-color areas.

FIG. 17 is a diagram showing the evaluation of images for the relationship between the width of the print medium and the occurrence of time difference unevenness observed if the special feeding is executed. A five-ranking sensory evaluation similar to that used in FIG. 14 is used as an evaluating method. If the special feeding is executed as described above, there is almost no difference in print time between adjacent areas at each end. Consequently, almost no time difference unevenness occurs. However, a larger print medium width results in a slightly lowered evaluation.

FIG. 18 is a diagram showing a table used to determine the conveyance control according to the present embodiment.

As shown in FIG. 18, when the width of the print medium is relatively small and of 24 inches or less, the time difference unevenness is not so marked. Accordingly, the normal feeding is executed. On the other hand, when the width of the print medium is relatively large and of 36 inches or more, the time difference unevenness is likely to be significant. Thus, the time difference unevenness can be suppressed as shown in FIG. 17 by selecting the special feeding.

Embodiment 3

In the present embodiment, the time difference unevenness is suppressed by selecting the scan speed of the print head, that is, the movement speed of the carriage during printing, depending on the width of the print medium.

FIG. 19 is a diagram showing the evaluation of images for the relationship between the width of the print medium and the occurrence of time difference unevenness observed if the movement speed of the carriage is changed. A five-ranking sensory evaluation similar to that used in FIG. 14 is used as an evaluating method. Evaluation is made for two cases of 25 inch/sec and 50 inch/sec. As is apparent from FIG. 19, with any print medium width, the print time difference decreases at the higher carriage speed, that is, 50 inch/sec. As a result, the time difference unevenness can be suppressed.

In the print control according to the present embodiment, in the step S503 of the process in FIG. 10, shown in connection with the first embodiment, the width of the print medium is determined on the basis of the print data. Then, a table described later in FIG. 20 is referenced to select one of different print modes with respective carriage speeds, on the basis of the determined width of the print medium.

FIG. 20 is a diagram showing a table referenced to determine the movement speed of the carriage. As shown in this figure, with a relatively small print medium width, the time difference unevenness is not significant even at the normal carriage speed, 25 inch/sec. Thus, 25 inch/sec is selected, at which ink droplets are likely to relatively accurately land to the print medium to improve the image quality. On the other hand, with a relatively large print medium width, the higher carriage speed, 50 inch/sec, is selected. This makes it possible to reduce the print time difference and thus the time difference unevenness. At 50 inch/sec, the accuracy with which the ink droplets land to the print medium slightly decreases. However, the resultant degradation of the image is slighter than that caused by the time difference unevenness. Therefore, the image grade is generally improved.

In the above example, the carriage speed is selected from the two values, 25 inch/sec and 50 inch/sec. However, as is apparent from the above description, similar effects can be produced regardless of the set carriage speed; for example, one of three values including 36 inch/sec may be selected, or either 12.5 inch/sec or 36 inch/sec may be selected.

It should be noted that the carriage speed may be set to be a high speed even when the width of print medium is small, so as to place priority on a print speed, even though the above described embodiment selects the carriage speed depending on the width of the print medium. The carriage speed may be selected from a plurality of carriage speeds depending on a print mode to be carried out preferentially such as a mode for print quality and a mode for a print speed, and the selective carriage speed may be more suppressed when the larger width of print medium is used. This configuration can also suppress the time difference unevenness when the relatively large width of print medium is used.

Embodiment 4

In the present embodiment, it is determined whether or not to dry the print medium (more specifically, to facilitate drying of the ink on the print medium), on the basis of the width of the print medium. This serves to suppress the time difference unevenness.

An arrangement for drying may employ a conventional technique and may or may not contact with the print medium. The arrangement may use heat or air currents for drying or may heat the print medium before or after printing.

FIG. 21 is a diagram showing the evaluation of images for the relationship between the width of the print medium and the occurrence of time difference unevenness observed if the print medium is dried. A five-ranking sensory evaluation similar to that used in FIG. 14 is used as an evaluating method. The addition of the drying process enables the permeation and fixation of the ink in the print medium to be maintained in a fixed state regardless of the difference in print time. Therefore, the time difference unevenness can be substantially suppressed.

In the print control according to the present embodiment, in the step S503 of the process in FIG. 10, shown in connection with the first embodiment, the width of the print medium is determined on the basis of the print data. Then, a table described later in FIG. 22 is referenced to select either a print mode with a drying process or a print mode without any drying process, on the basis of the determined width of the print medium.

FIG. 22 shows the table. As shown in this figure, for a relatively small print medium width, the drying process is not executed. With a relatively small print medium width, the time difference unevenness does not significantly affect the image grade as previously described, so that the drying process is not executed. This simplifies the print control and also reduces power consumption. On the other hand, for a relatively large print medium width, the drying process is executed. This facilitates the permeation and fixation of the ink to reduce the difference in density between the opposite ends of the scan area caused by a difference in permeation corresponding to the difference in print time. Therefore, the time difference unevenness can be inhibited.

Embodiment 5

In all of the above examples, the width of the print medium is detected and the print control is switched in accordance with the detected width to make the time difference unevenness less noticeable. However, the application of the present invention is not limited to this aspect. In each of Embodiments 1 to 4, described above, the actual print width may be detected instead of the width of the print medium. This print width relates to the scan range of the print head and contributes to defining the print time difference in the scan area.

The print width is the width of an image printed on the print medium in the scanning direction. In the present embodiment, the print width is the maximum width in data for one page. Alternatively, the print width may be the length of a leading row in one page. Then, the print head is controlled to be scanned within the rage corresponding to the print width. For example, when the print width is smaller than the width of the print medium, the print head is not scanned all over the width of the print medium but is scanned within the range of the print width, which is smaller than the width of the print medium and which is required to print an image or the like on the basis of the print data.

That is, the range of scanning of the print head corresponds to the print width and increases consistently with it. Accordingly, the time difference unevenness resulting from the reciprocative scanning correspondingly becomes marked. Thus, in the present embodiment, when information on the print width is obtained and has at least a predetermined value, the resultant time difference unevenness can also be made insignificant by performing the print control described in any of Embodiments 1 to 4.

Embodiment 6

In the present embodiment, the print control is switched in accordance with the print width as in the case of Embodiment 5, described above. The present embodiment differs from Embodiment 5 in that the print width is determined for each print data for one band width so that the print mode is switched in accordance with the print width determined. Specifically, the print control is the switching of the number of passes as in the case of Embodiment 1.

Figure 23:
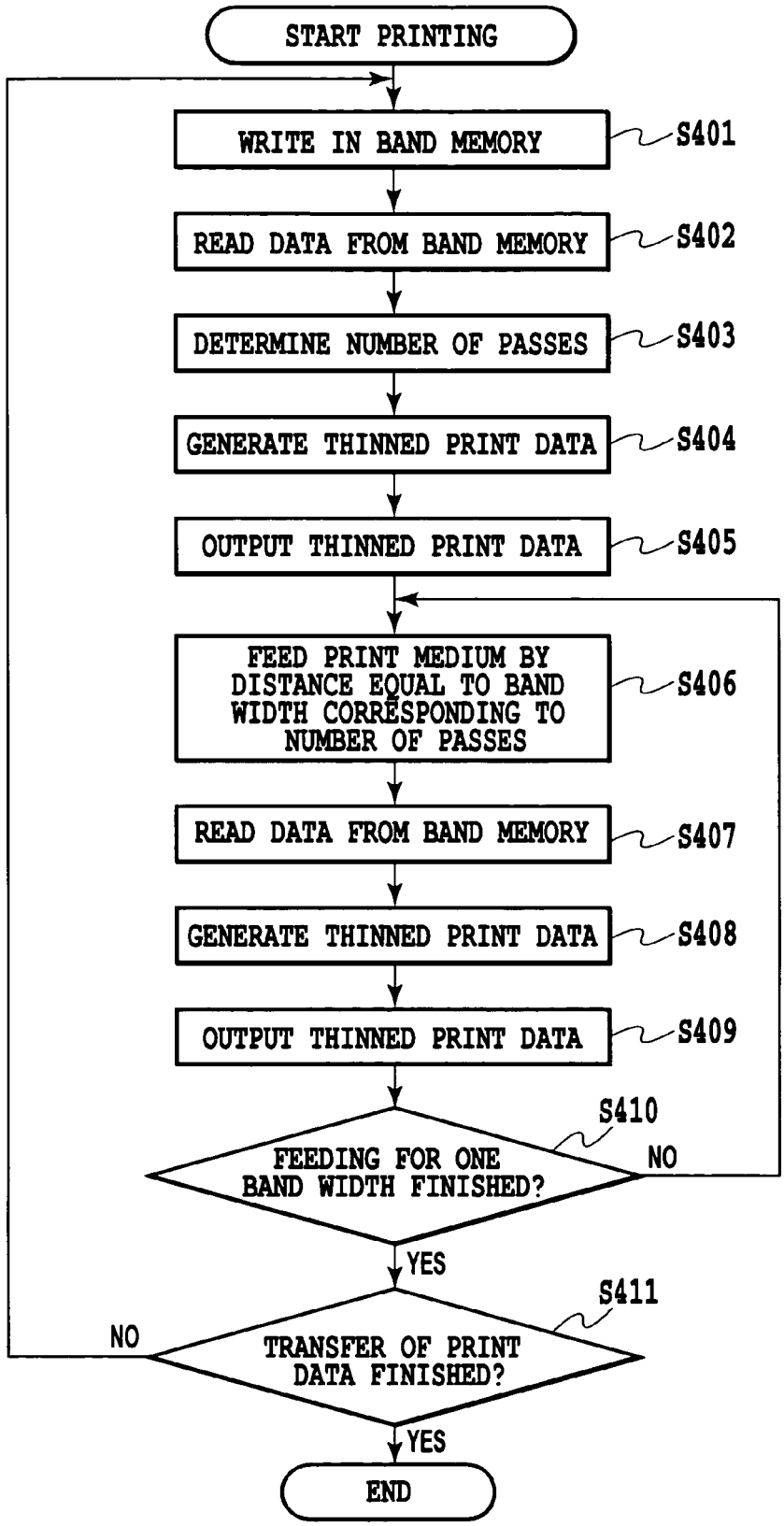
FIG. 23 is a flow chart showing a procedure of print control according to a sixth embodiment of the present invention.

FIG. 23 is a flow chart showing the procedure of a printing operation according to the present embodiment.

In FIG. 23, the host device 205 first inputs a print instruction command and print data to the CPU 201 via the interface 206. The CPU 201 then writes print data for one band in the band memory 207 (step S401). Then, the multi-pass data processing section 209 reads all the image data for one band from the band memory 207 (step S402).

Then, the CPU 201 then determines the print width on the basis of the information read and determines the number of passes in multi-pass printing according to the determined print width (step S403). More specifically, the CPU 201 executes 2- or 8-pass multi-pass printing by referencing a table described later in FIG. 24 on the basis of the print width determined. To accomplish this, the CPU 201 first determines the print width as a reference for determining the number of passes. The print width is the width of an image printed on the print medium in the scanning direction. In the present embodiment, the print width is the maximum width of the image expressed by the one band data read. Then, the print head is controlled to be scanned within the rage corresponding to the print width. For example, when the print width is smaller than the width of the print medium, the print head is not scanned all over the width of the print medium but is scanned within the range of the print width, which is smaller than the width of the print medium and which is required to print an image or the like on the basis of the print data.

FIG. 24 is a table showing the relationship between the number of passes and the width of the print medium used to determine the number of passes (step S403). The present embodiment uses 8 pass printing when the print width is relatively large and of 36 inches or more. The present embodiment uses 2 pass printing when the print width is relatively small and of 24 inches or less.

In this process of determining the number of passes (step S403), in addition to the above described process of determining the number of passes, when it is determined that the number of passes be changed, a process of switching the number of passes is executed in addition to or together with the next step S404 and subsequent process. This switching process can be executed using, for example, a method described in Japanese Patent Application Laid-open No. 07-237321 (1995). For example, if the 2 pass printing is switched to the 8 pass printing, the print medium is conveyed by a distance corresponding to a half band width for the 2 pass printing. Then, eight scans are executed without conveying the print medium. Further, the number of ejection openings used to eject the ink from the print head is sequentially incremented by a value corresponding to a ⅛ band width. If the 8 pass printing is switched to the 2 pass printing, eight scans are executed without conveying the print medium by a distance corresponding to the ⅛ band width. Further, the number of ejection openings used to eject the ink from the print head is sequentially incremented by the value corresponding to the ⅛ band width. The print area remaining to be completed is completed during the second pass.

Then, in steps S404 to S406, print data is generated by thinning, a printing operation is performed by outputting print data, and the print medium is conveyed. These processes correspond to the above process of switching the number of passes if the latter is executed.

First, in the step S404, the multi-pass data processing section 209 executes a thinning process corresponding to the number of passes determined. For example, a thinning process for the 2 pass printing is executed on image data read from the band memory 207 using mask patterns shown in FIGS. 12A and 12B. The checker pattern shown in FIG. 12A is used for the first pass of the 2 pass printing as a mask pattern for thinning print data. The reverse checker pattern shown in FIG. 12B is used for the second pass executed after the feeding of the print medium in the step S406, as a mask pattern for thinning print data. In reciprocative scanning according to the present embodiment, for example, during the first scan, the print head 2 is scanned forward in the direction X1 shown in FIG. 13. During the second scan, the print head 2 is scanned backward in the direction X2. Then, in the step S405, the CPU outputs the print data generated by thinning in the step S404 to the head controller 210. Further, the CPU causes the print head 2 to eject the ink while scanning the carriage 1 in the main scanning direction, to print an image on the print sheet. That is, on the basis of the print data generated using the checker pattern in the step S404, the print head 2 ejects the ink while being scanned forward in the direction X1, to print a thinned image all over the area for one scan, as shown in a stage A shown in FIG. 13. Moreover, in the step S406, the print medium is conveyed by an amount corresponding to the number of passes determined in the step S403. For example, for the two pass printing, the print sheet is conveyed in the backward scan direction of the arrow Y by an amount corresponding to the half band width. As shown in FIG. 13, in the step S406, the print head 2 lies at the position B offset from the position A by the half band width.

In a step A407, the same data as the one for one band read in the step S402 is read again. In the next step S408, for example, for the 2 pass printing, print data is generated by a thinning process using the reverse checker mask pattern shown in FIG. 12B. Then, in a step S409, the second pass printing shown in FIG. 13 is executed.

Then, in a step S410, the print data sent from the host in the step S401 is written. It is then determined whether or not the accumulating total of the fed amounts resulting from the processing in the step S406 has reached a value corresponding to one band width. That is, when the conveyance of the print medium causes the print head to correspond to an area in which print data not sent by the host yet is to be printed, the process returns to the step S410 (via a determination in a step S411) to write the print data sent by the host device. Then, in the present embodiment, every time new data is written, the print width is determined on the basis of that data. The number of passes is then determined in accordance with the determination (steps S402 and S403).

When it is determined in the step S410 that the conveyance for one band has not been finished, the processing between steps S406 and S409 is repeated. Then, once the printing of one print sheet is completed, the present process is ended (step S411).

Figure 6:
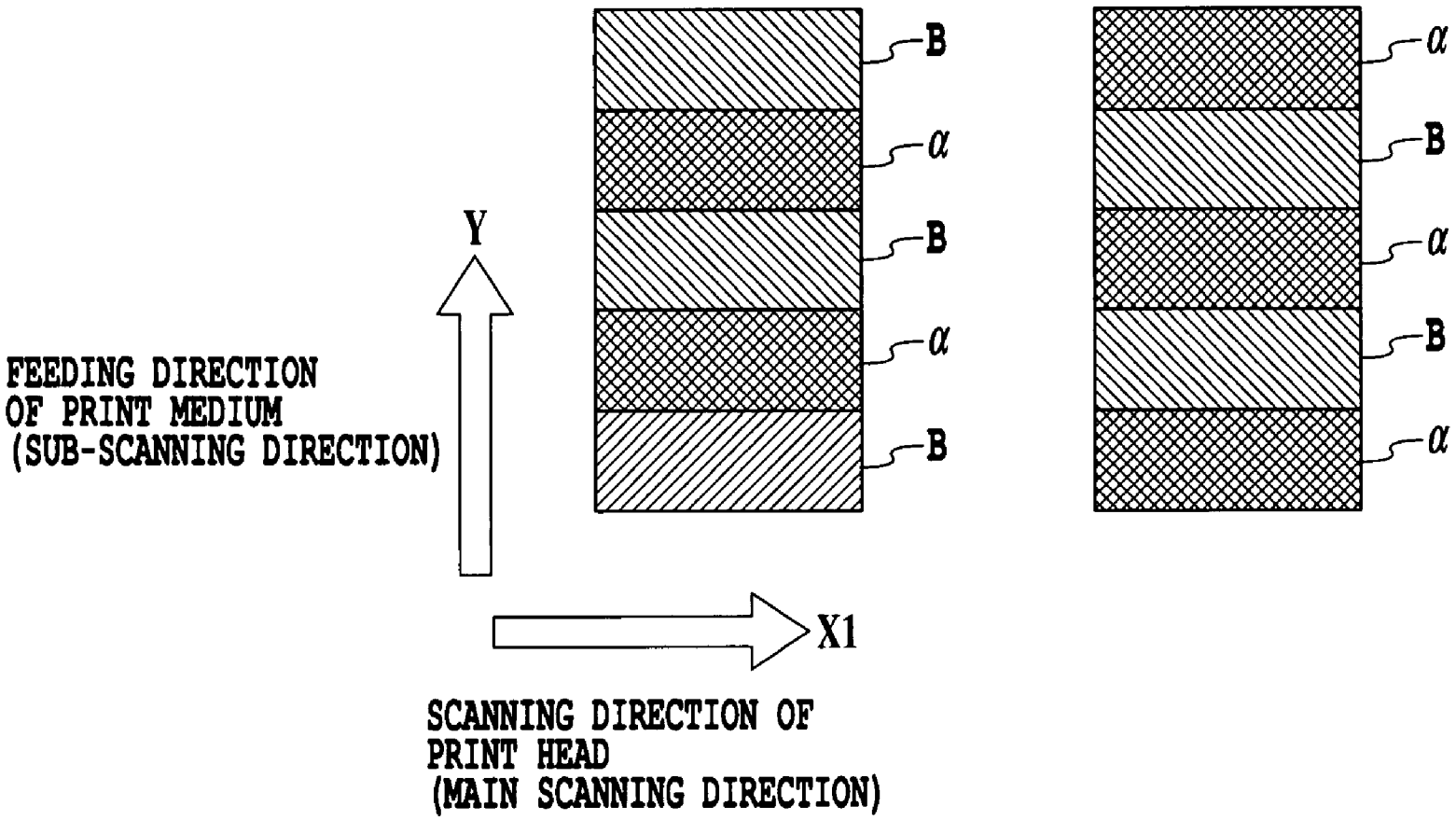
FIG. 6 is a diagram illustrating the occurrence of time difference unevenness corresponding to a uneven density resulting from the difference in print time at the opposite ends of the print image.

FIG. 25 is a diagram showing the relationship between the print width for the 2 pass printing and the corresponding print time difference. This figure shows, for each print width, the print time difference at the left end of the print area shown in FIG. 6. Symbols similar to those in FIG. 6 are used. Symbol α indicates a large print time difference between the printing of the 1/2 pass print area and the printing of the 2/2 pass print area. Symbol B indicates a small print time difference between the printing of the 1/2 pass print area and the printing of the 2/2 pass print area. As is apparent from FIG. 25, the differential α−B in the print time difference between the areas α and B, which are alternately present in the sub-scanning direction, increases consistently with the print width. The differential corresponds to the difference in density between the alternately appearing areas. Therefore, the time difference unevenness increases consistently with the print width.

FIG. 26 is a diagram showing this and the evaluation of images for the relationship between the print width and the occurrence of time difference unevenness in the 2-pass printing. The same evaluating method as shown in FIG. 14 is used.

FIG. 27 is a diagram showing the evaluation of images for the relationship between the print width and the occurrence of time difference unevenness observed when 8-pass printing is executed using the same print width as shown in FIG. 26. An evaluating method is used which is similar to the five-ranking sensory evaluation shown in FIG. 14.

In the 8 pass printing, the same area is scanned eight times, which is four times as frequent as the twice in the 2 pass printing. This reduces the size of each of the areas α and B, while increasing the cycle frequency at which these areas are alternately repeated. As a result, the time difference unevenness is not perceived easily. In this manner, even with the same print width, the time difference unevenness can be made less noticeable by increasing the number of passes.

In view of this, in the print control described above in FIG. 23, a table shown in FIG. 24 is used to perform control such that the number of passes is switched in accordance with the print width.

As shown in FIG. 24, with a relatively small print width, the time difference unevenness does not occur even in the 2 pass printing. Accordingly, the 2 pass printing, which improves throughput, is selected. With a relatively large print width, selection of the 2 pass printing may make the time difference unevenness significant. Accordingly, the time difference unevenness is suppressed by selecting the 8 pass printing.

As described above, in the present embodiment, by selecting the number of passes corresponding to the print width for each band data in the bidirectional multipass printing, it is possible to more accurately suppress the time difference unevenness resulting from the bidirectional printing.

Embodiment 7

In the present embodiment, the scanning direction is switched in accordance with the width of the print medium described above. That is, with a large print medium width, the bidirectional printing is switched to the one-directional printing to inhibit the time difference unevenness.

Specifically, in the processing in the step S503 or S403 of the print control shown in FIG. 10, the width of the print medium is detected. Then, the bidirectional or unidirectional print mode is selected depending on the width detected.

Figure 28:
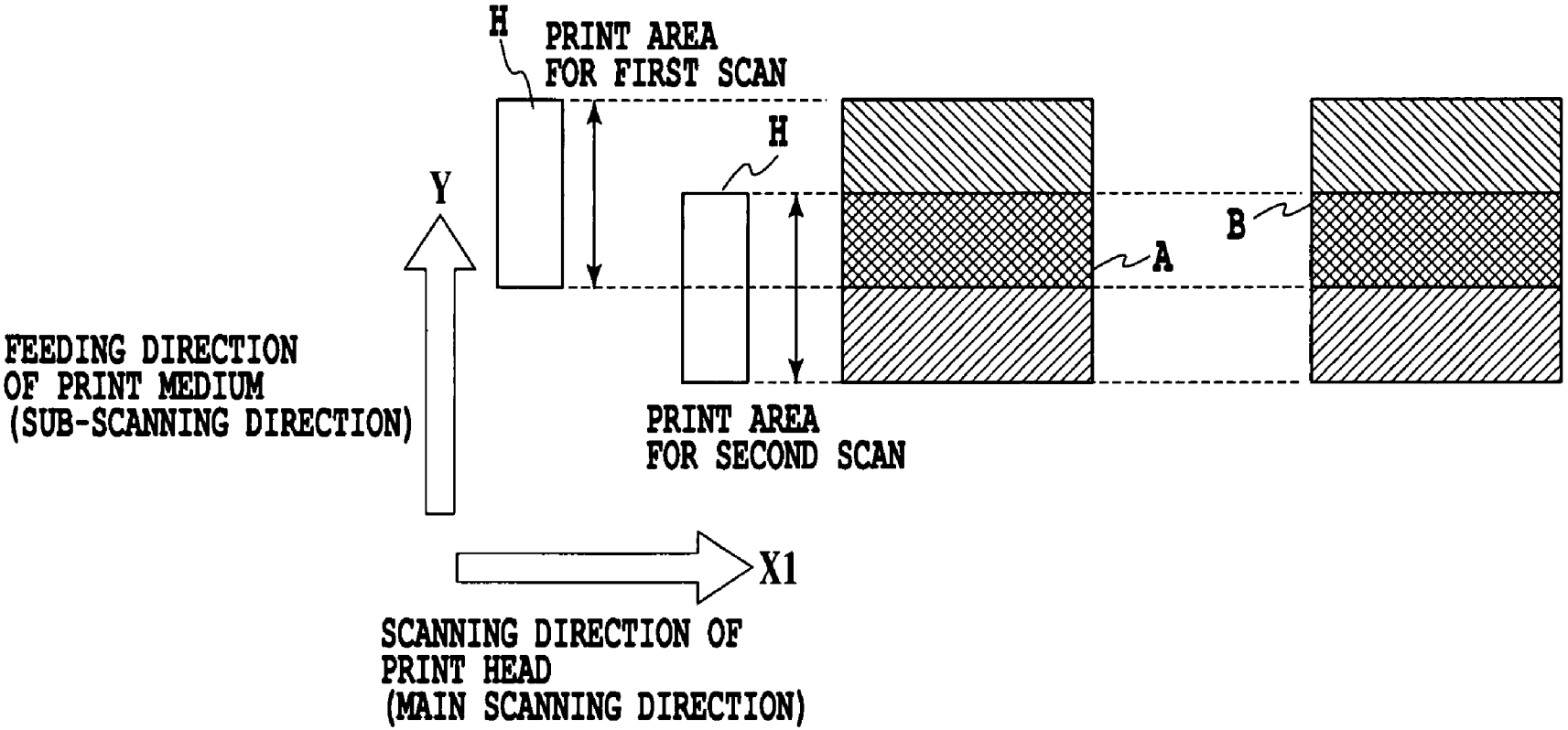
FIG. 28 is a diagram illustrating a difference in print in unidirectional 2 pass printing.

FIG. 28 is a diagram illustrating the difference in print time in the unidirectional 2 pass printing. During the first scan, rightward printing is executed. Then, the carriage is simply moved backward, that is, leftward, without executing printing. During the second scan, rightward printing is executed again. In this case, in one A of the areas A and B at the left and right ends, respectively, of the print image, the 1/2 pass printing is executed in the initial stage in which the print head executes rightward printing. The print head continuously executes rightward printing and then starts to return at the right end. Then, the carriage simply moves leftward without executing printing. Then, as in the case of the 1/2 pass, the 2/2 pass printing is executed in the initial stage in which the print head executes rightward printing. As a result, there is a relatively large difference in print time between the 1/2 pass printing and the 2/2 pass printing. This also applies to the area B at the right end. There is a large difference in print time between the 1/2 pass printing and the 2/2 pass printing.

Figure 29:
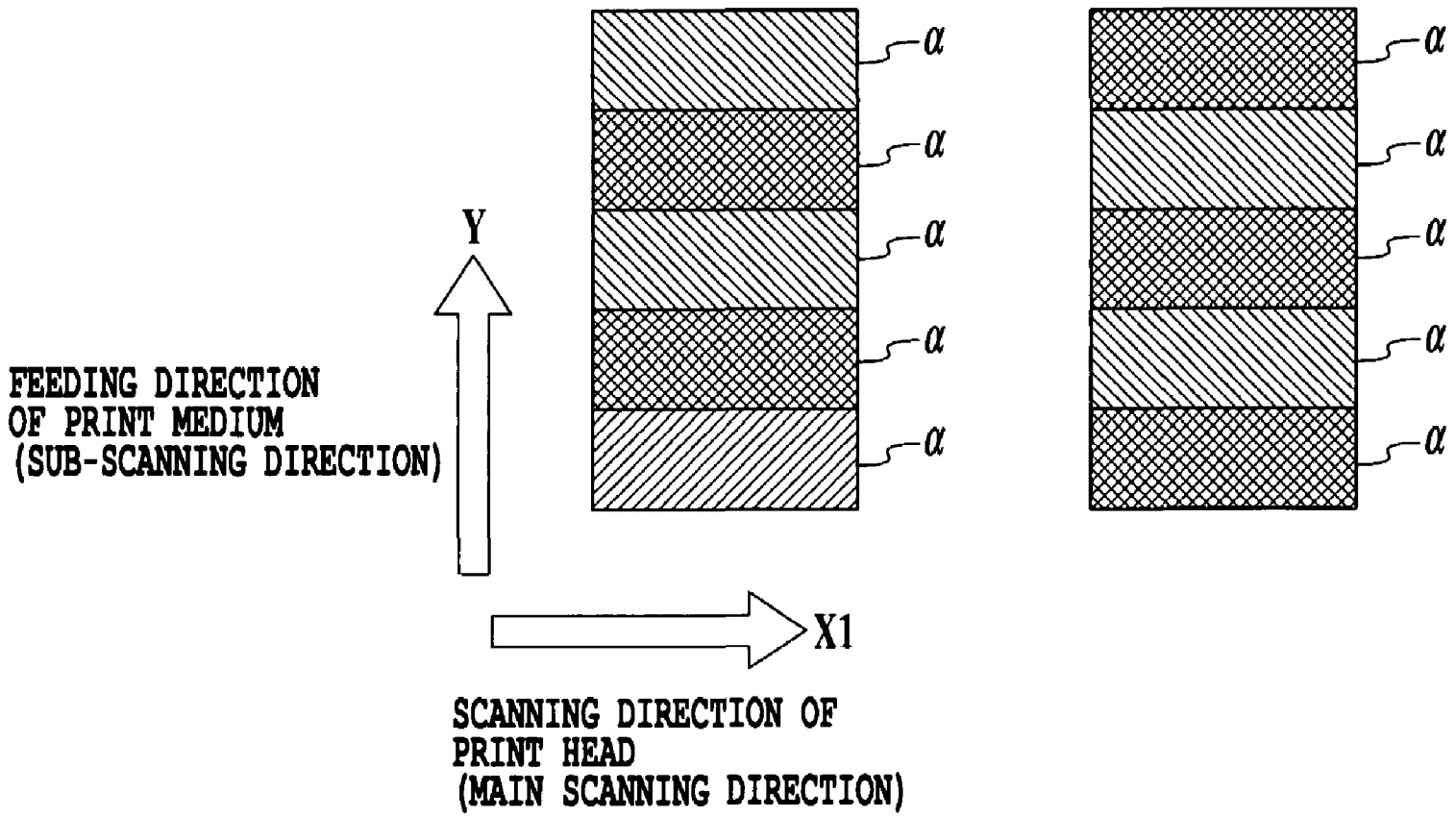
FIG. 29 is a diagram illustrating how a difference in print time occurs during the unidirectional printing.

FIG. 29 is a diagram showing how a print time difference in the bidirectional 2 pass printing appears at the opposite ends of the print image. As in the case of the above embodiments, if a reference sign α is used to indicate a large distance in print time between the 1/2 pass printing and the 2/2 pass printing and a reference sign B is used to indicate a small distance in print time, then only the area α occurs in FIG. 29 because there is the same difference in time at the opposite ends A and B as described in FIG. 28. Consequently, time difference unevenness does not occur in which a dark- and light-color areas are repeated at the opposite ends of the image.

FIG. 30 is a diagram showing the evaluation of images for the relationship between the width of the print medium and the occurrence of time difference unevenness observed when one-directional printing is executed. An evaluating method is used which is similar to the five-ranking sensory evaluation used in FIG. 14. As previously described, the difference in print time is almost equal in the one-directional printing, resulting in almost no time difference unevenness.

FIG. 30 is a diagram showing a table referenced in selecting the one-directional printing or the bidirectional printing. As shown in this figure, for a relatively small print medium width, the bidirectional printing is selected. On the other hand, with a relatively large print medium width, selection of the bidirectional printing makes the time difference unevenness significant. Accordingly, the one-directional printing is selected to suppress the time difference unevenness.

OTHER EMBODIMENTS

In Embodiment 6, described above, the print control corresponding to the print width detected switches the number of passes. However, any of the print control operations described in Embodiments 2 to 4 may be applied as the print control for Embodiment 6.

In the above embodiments, printing is executed using the yellow, magenta, cyan, light magenta, light cyan, and black inks. However, the combination of inks used is not limited to this aspect. As is apparent from the above description, the application of the present invention does not depend on the combination of inks used.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2003-385747 filed Nov. 14, 2003, which is hereby incorporated by reference herein.

What is claimed is:

1. A printing apparatus which performs printing on a print medium by executing an operation of causing a print head to eject inks while scanning the print head multiple times over the same area of the print medium in a reciprocating manner and an operation of feeding the print medium in a direction different from that in which the print head is scanned, said apparatus comprising:

obtaining means for obtaining information on the width of the print medium used for printing or a print width corresponding to print data; and changing means for changing the number of multi-scans of the print head in accordance with the information obtained by said obtaining means, wherein if the information obtained by said obtaining means indicates a width equal to or larger than a predetermined value, said changing means increases the number of the multi-scans.

2. A printing method of performing printing on a print medium by executing an operation of causing a print head to eject inks while scanning the print head multiple times over the same area of the print medium in a reciprocating manner and an operation of feeding the print medium in a direction different from that in which the print head is scanned, said method comprising the steps of:

obtaining information on the width of the print medium used for printing or a print width corresponding to print data; and changing the number of multi-scans of the print head in accordance with the information obtained in said obtaining step, wherein if the information obtained in said obtaining step indicates a width equal to or larger than a predetermined value, the number of the multi-scans is increased in said changing step.

3. A printing apparatus which performs printing on a print medium by executing an operation of causing a print head to eject inks while scanning the print head multiple times over the same area of the print medium in a reciprocating manner and an operation of feeding the print medium in a direction different from that in which the print head is scanned, said apparatus comprising:

obtaining unit configured to obtain information on the width of the print medium used for printing or a print width corresponding to print data; and determining unit configured to determine the number of multi-scans of the print head in accordance with the information obtained by said obtaining unit, wherein said determining unit determines a predetermined number as the number of the multi-scans if the information obtained by said obtaining unit indicates a width smaller than a predetermined width, and wherein said determining unit determines a number larger than the predetermined number as the number of the multi-scans if the information obtained by said obtaining unit indicates a width equal to or larger than the predetermined width.

4. A printing method of performing printing on a print medium by executing an operation of causing a print head to eject inks while scanning the print head multiple times over the same area of the print medium in a reciprocating manner and an operation of feeding the print medium in a direction different from that in which the print head is scanned, said method comprising the steps of:

obtaining information on the width of the print medium used for printing or a print width corresponding to print data; and determining the number of multi-scans of the print head in accordance with the information obtained by said obtaining unit, wherein a predetermined number as the number of the multi-scans is determined in said determining step if the information obtained in said obtaining step indicates a width smaller than a predetermined width, and a number larger than the predetermined number as the number of the multi-scans is determined in said determining step if the information obtained in said obtaining step indicates a width equal to or larger than the predetermined width.

* * * * *